US007815187B2

(12) United States Patent
Yokota

(10) Patent No.: US 7,815,187 B2
(45) **Date of Patent: *Oct. 19, 2010**

(54) ROULETTE BOARD AND METHOD FOR CONTROLLING THE SAME

(75) Inventor: Tetsuya Yokota, Tokyo (JP)

(73) Assignee: Universal Entertainment Corporation, Koto-ku, Tokyo (JP)

( * ) Notice: Subject to any disclaimer, the term of this patent is extended or adjusted under 35 U.S.C. 154(b) by 357 days.

This patent is subject to a terminal disclaimer.

(21) Appl. No.: 11/431,935

(22) Filed: May 11, 2006

(65) Prior Publication Data

US 2006/0287053 A1 Dec. 21, 2006

(30) Foreign Application Priority Data

May 12, 2005 (JP) ..... 2005-140051

(51) Int. Cl.
*A63F 5/02* (2006.01)

(52) U.S. Cl. ..... 273/142 E; 273/142 R

(58) Field of Classification Search ..... 463/22; 273/142 E

See application file for complete search history.

(56) References Cited

U.S. PATENT DOCUMENTS

| | | | | |
|---|---|---|---|---|
| 3,870,307 | A * | 3/1975 | Meyer et al. | 273/121 A |
| 3,901,508 | A | 8/1975 | Spangler | |
| 4,906,005 | A | 3/1990 | Manabe | |
| 5,048,832 | A * | 9/1991 | Kaminkow | 273/129 V |
| 5,755,440 | A * | 5/1998 | Sher | 273/142 E |
| 6,083,105 | A * | 7/2000 | Ronin et al. | 463/17 |
| 6,520,854 | B1 | 2/2003 | McNally | |
| 7,311,305 | B2 * | 12/2007 | Matsuno et al. | 273/142 E |
| 2005/0003885 | A1 | 1/2005 | Rhoten | |

FOREIGN PATENT DOCUMENTS

| | | |
|---|---|---|
| FR | 2 390 978 | 12/1978 |
| GB | 2 395 139 A | 5/2004 |
| JP | 08-229190 | 9/1996 |
| JP | 8-229191 | 9/1996 |
| JP | 08229191 | 9/1996 |
| WO | WO 03/051476 A1 | 6/2003 |
| WO | WO 2004/094013 A1 * | 11/2004 |

OTHER PUBLICATIONS

Eurasian Search Report Dated Oct. 31, 2006, with partial English translation.

Korean Office Action dated Oct. 27, 2009 with an English translation.

* cited by examiner

*Primary Examiner*—Peter DungBa Vo
*Assistant Examiner*—Omkar Deodhar
(74) *Attorney, Agent, or Firm*—McGinn IP Law Group, PLLC

(57) ABSTRACT

A roulette board includes: a roulette wheel on which a plurality of symbols are arranged in a circumferential direction of the roulette wheel; a plurality of ball reception portions that are provided in a one-to-one correspondence with the symbols, the ball reception portions being configured to receive a ball that rolls on the roulette wheel; a banked passage that is endlessly provided along an outer circumference of the roulette wheel, and allows the ball to roll in a circumferential orbit; and a ball discharging mechanism that is provided with a ball discharging member and discharges the ball received in one of the ball reception portions toward the banked passage by bringing the ball discharging member into contact with the ball.

20 Claims, 24 Drawing Sheets

ROULETTE BOARD AND METHOD FOR CONTROLLING THE SAME

CROSS-REFERENCE TO THE RELATED APPLICATION(S)

The present application is based upon and claims priority from prior Japanese Patent Application No. 2005-140051, filed on May 12, 2005, the entire contents of which are incorporated herein by reference.

TECHNICAL FIELD

The present invention relates to a roulette board and a method for rolling a ball on a roulette wheel and storing the ball in one of ball reception portions provided in a one-to-one correspondence with symbols placed on the roulette wheel. In particular, the present invention relates to a roulette board and a game control method for bringing the ball received in one of the ball reception portions into contact with a ball discharging mechanism for discharging the ball, thereby simplifying the structure and facilitating maintenance.

BACKGROUND

A so-called medal game that uses a medal as a game medium is a game that starts by a player who purchases or borrows a plurality of medals with a medal lending machine and inputting the medal to a gaming machine such as a roulette gaming machine. When the player wins the game, a predetermined number of medals are paid out to the player. Therefore, the player who gains a large number of medals can enjoy a successive game without purchasing or borrowing new medals.

Particularly with the roulette gaming machine, when the player selects a mark or number (symbols) placed on the roulette wheel, the roulette wheel rotates and a ball rolls on the roulette wheel. When the rotation of the roulette wheel grows weak and the ball is received and retained in any groove in the roulette wheel, it is determined that whether or not the symbol selected by the player matches the symbol in which the ball is received (When matches, the player wins the game.). When it is determined that the ball is received in the same symbol as that selected by the player, medals are paid out to the player at a predetermined multiplication.

Hitherto, the roulette gaming machine has been provided with a ball collection mechanism for collecting the ball from the roulette wheel to re-discharge the ball used in the preceding game onto the roulette wheel. For example, a roulette gaming machine described in JP-A-8-229191 is as follows: Each ball reception portion of a rotating wheel is formed with a ball passage hole and a fixed wheel is formed with a flange for closing the ball passage hole and a notch is formed in apart of the flange. The notch is provided with an opening-closing plate for opening and closing the notch as a solenoid is driven. When the ball is collected, the notch is opened for allowing the ball to drop from the wheel without providing a mechanism for lifting up the rotating will, whereby to miniaturize a bucket.

However, the roulette gaming machine described in the document JP-A-8-229191 requires a complicated mechanism below the roulette wheel for storing the ball collected from the roulette wheel and re-discharge the ball onto the roulette wheel.

Since each ball reception portion requires a moving part such as a shutter for opening and closing the ball passage hole, the cost increases and the fear of aborting the game due to a trouble caused in the moving part is high. Further, maintenance of the apparatus is intricate.

Since each ball reception portion needs to be formed with a ball passage hole, the ball reception portion requires a given or more depth and a part of the ball received in the ball reception portion is buried from the top of the roulette wheel. On the other hand, the roulette wheel needs to be formed with a discharging opening for discharging the collected ball onto the roulette wheel. Therefore, the roulette wheel is needs to have a predetermined or more height. This point will be discussed below as a specific example shown in FIGS. 23 and 24.

FIGS. 23 and 24 are schematic drawings to show a roulette board used with a roulette gaming machine according to a related art. As shown in FIG. 23, a roulette board 200 in the related art is provided with a large number of ball reception portions 202 formed in the circumferential direction of a roulette wheel 201. Each ball reception portion 202 is formed with a ball passage hole 204 for once collecting a ball 203 received in the ball reception portion 202 after a game is over, and further a ball collection section 205 for once storing the ball 203 passing through the ball passage hole 204 is attached to the outside of the ball passage hole 204. On the other hand, a ball discharging opening 207 is formed in a banked passage 206 where the ball 203 draws circular motion. The ball 203 collected through the ball passage hole 204 is once received in the ball collection section 205 and is transported to a ball discharging unit. Then, the ball 203 discharged by the ball discharging unit is discharged into the roulette wheel 201 through the ball discharging opening 207 and rolls on the top of the roulette wheel 201.

Since the ball reception portion 202 needs to be formed with the ball passage hole 204 for transporting the ball 203 to the outside, a height "h1" of the ball reception portion 202 needs to be set higher than the diameter of the ball 203. Further, the banked passage 206 needs to be formed with the ball discharging opening 207 and therefore a height "h2" of the roulette wheel 201 needs to be made equal to or higher than a predetermined value (for example, 143 mm).

Therefore, a viewing angle $\alpha$ for enabling a player 209 playing a game with a gaming machine 208 including the roulette board 200 at the position of a height "H1" to recognize the ball 203 regardless of which ball reception portion 202 the ball 203 is received in narrows as shown in FIG. 24. Thus, the height of the eyepoint of the player 209 needs to be "H2" or more. Specifically, if "H1" is set to about 900 mm and $\alpha$ is set to 50 degrees, "H2" becomes about 1400 mm and it is impossible for an ordinary player 209 to recognize the ball 203 in the roulette wheel 201 unless the player gets up from seat. Particularly, a player 209 with a low eyepoint must not only get up from seal, but also move the stand position to another. Thus, it becomes difficult for the player to recognize the ball, leading to degradation of game play amusement.

SUMMARY

One of objects of the present invention is to provide a roulette board and a method for improving maintenance and reducing the apparatus cost without any complicated mechanism of moving parts for collecting a ball and a discharging unit.

Another object of the invention is to provide a roulette board and a method for improving a visibility of a ball and improving an amusement of the game play.

According to one aspect of the invention, there is provided a roulette board including: a roulette wheel on which a plurality of symbols are arranged in a circumferential direction of the roulette wheel; a plurality of ball reception portions that are provided in a one-to-one correspondence with the symbols, the ball reception portions being configured to receive a ball that rolls on the roulette wheel; a banked passage that is endlessly provided along an outer circumference of the roulette wheel, and allows the ball to roll in a circumferential orbit; and a ball discharging mechanism that is provided with a ball discharging member and discharges the ball received in one of the ball reception portions toward the banked passage by bringing the ball discharging member into contact with the ball.

According to another aspect of the invention, there is provided a method for controlling a roulette board. The roulette board includes: a roulette wheel on which a plurality of symbols are arranged in a circumferential direction of the roulette wheel; a plurality of ball reception portions that are provided in a one-to-one correspondence with the symbols, the ball reception portions being configured to receive a ball that rolls on the roulette wheel; a banked passage that is endlessly provided along an outer circumference of the roulette wheel, and allows the ball to roll in a circumferential orbit; and a ball discharging mechanism that is provided with a ball discharging member and discharges the ball received in one of the ball reception portions toward the banked passage by bringing the ball discharging member into contact with the ball. The roulette wheel includes: a fixed center section that is provided with the ball discharging mechanism; a rotating circumferential section that surrounds the fixed center section, the rotating circumferential section being provided with the symbols and the ball reception portions; and a support member that supports the rotating circumferential section to be rotatable with respect to the fixed center section. The roulette board further comprising a drive unit that rotates the rotating circumferential section with respect to the fixed center section. The method includes: receiving the ball in one of the ball reception portions after rolling the ball on the roulette wheel for a predetermined time period; detecting a received ball reception portion from among the ball reception portions, the received ball reception portion receiving the ball therein; controlling the drive unit to rotate the rotating circumferential section so that the received ball reception portion locates at a position where the ball discharging member is contactable with the ball received in the received ball reception portion; and discharging the ball received in the received ball reception portion toward the banked passage with the ball discharging mechanism.

DETAILED DESCRIPTION

A roulette gaming machine 1 including a roulette board according to an embodiment will be discussed in detail with reference to the accompanying drawings.

The roulette gaming machine 1 is a gaming machine in which a player predicts a symbol (i.e. a mark or a number) determined in a roulette board 2 and bets a game medium such as medals on the predicted symbol. When the symbol on which the player bets wins, the player receives payout of a predetermined number of medals.

Figure 1:
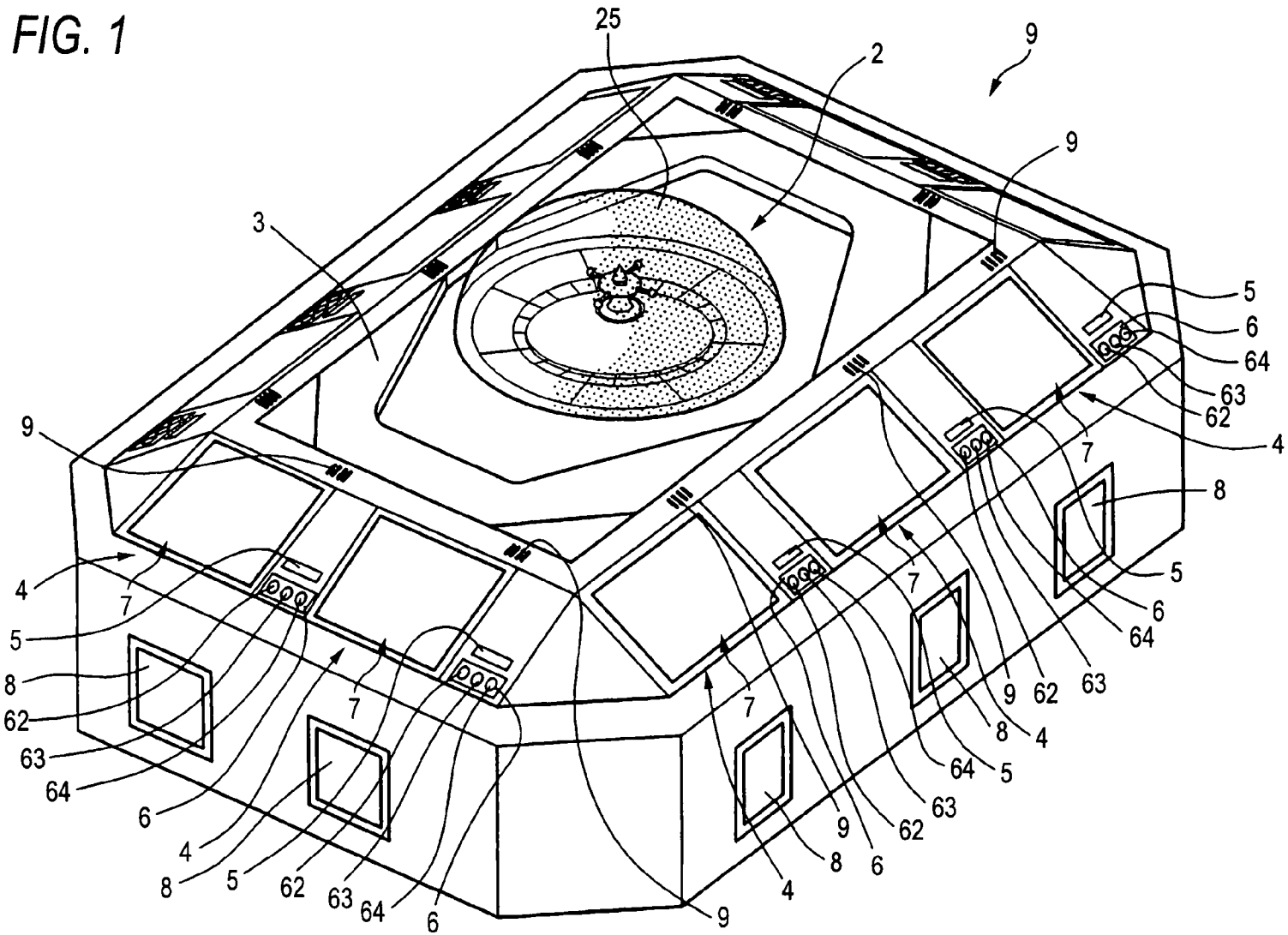
FIG. 1 is an external perspective view to show a schematic configuration of a roulette gaming machine according to an embodiment.

A schematic configuration of the roulette gaming machine 1 according to the embodiment will be discussed with reference to FIG. 1. FIG. 1 is an external perspective view showing the schematic configuration of the roulette gaming machine 1 according to the embodiment.

As shown in FIG. 1, the roulette gaming machine 1 includes a cabinet 3 as a main body, a roulette board 2 provided roughly in the center of the top face of the cabinet 3, and a plurality of (in the embodiment, ten) satellites 4 placed so as to surround the roulette board 2.

The satellite 4 is an operation unit provided with: a medal insertion slot 5 for inputting game media such as coins and medals for playing a game; a control section 6 including a plurality of control buttons operated by a player for entering commands; and an image display 7 for displaying an image involved in a game. The player operates the control section 6 while viewing the image displayed on the image display 7, thereby advancing the game performed.

Medal payout openings 8 are provided on the sides of the cabinet 3 where the satellites 4 are installed. Further, a speaker 9 for producing music and sound effects is provided at a top right of the image display 7 of each satellite 4.

A medal sensor (not shown) is provided inside the medal insertion slot 5 for identifying the game media such as medals input through the medal insertion slot 5 and counting the number of the input medals. A hopper (not shown) is provided inside the medal payout opening 8 for paying out a predetermined number of medals from the medal payout opening 8.

Figure 2:
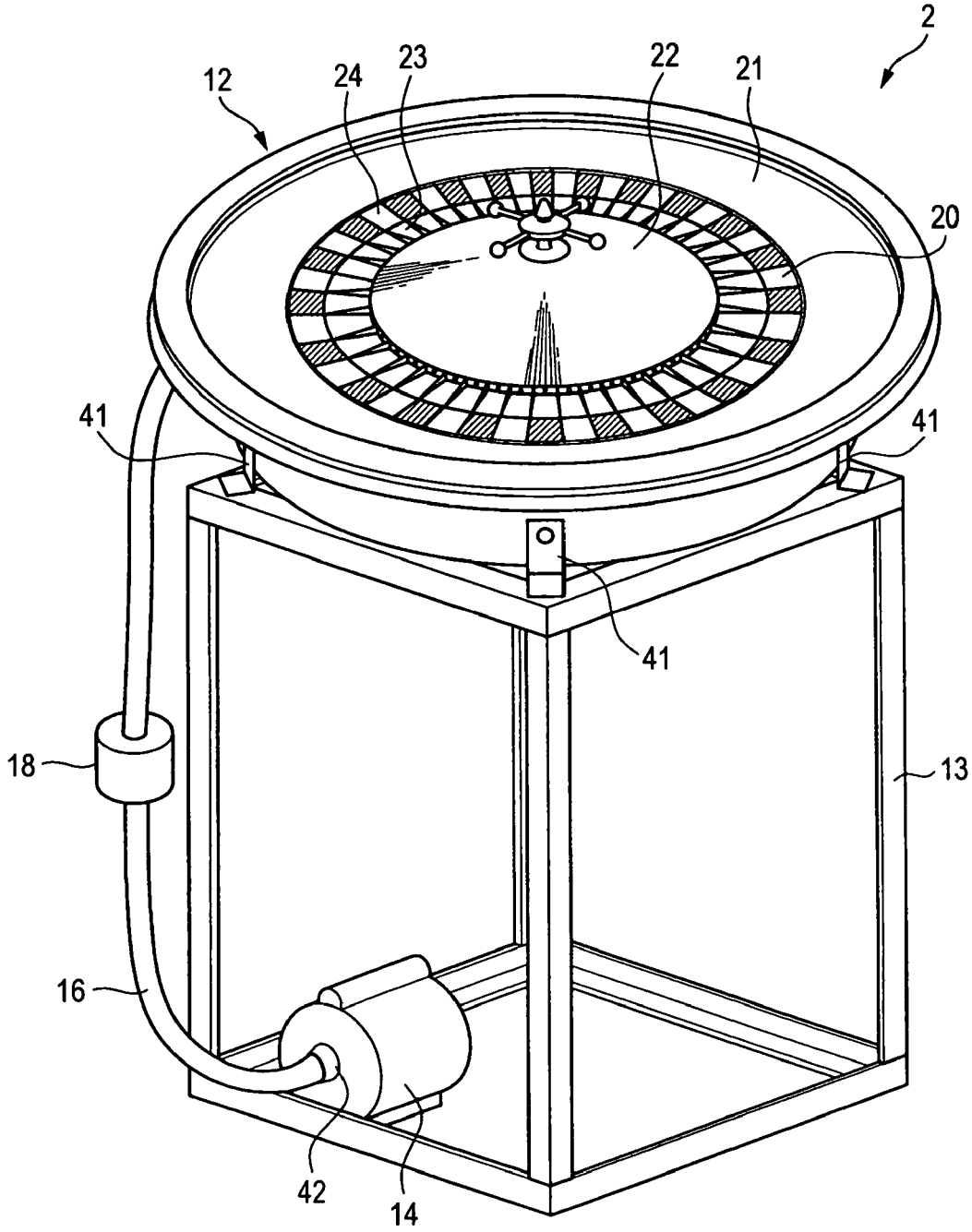
FIG. 2 is a perspective view to show a roulette board according to the embodiment.

Next, the schematic configuration of the roulette board 2 according to the embodiment will be discussed with reference to FIG. 2. FIG. 2 is a perspective view to show the roulette board according to the embodiment.

As shown in FIG. 2, the roulette board 2 includes: a roulette wheel 12 having a roll area where a ball 11 rolls during a game; a support base 13 for supporting the roulette wheel 12 inside the roulette gaming machine 1; a compressor 14 for taking in surrounding air and compressing the taken-in air to a predetermined pressure; an air tube 16 for sending the air compressed by the compressor 14; and an on-off valve 18 being provided at an intermediate point of the air tube 16 for adjusting the pressure of the air flowing through the air tube 16.

The roulette wheel 12 includes: a frame 21 fixed to the support base 13; a fixed center section 22 fixed and supported inside the frame 21; and an annular rotating circumferential section 20 provided surrounding the fixed center section 22. The rotating circumferential section 20 is formed on the top face with a large number of (in the embodiment, 38) concave ball reception portions 23 in the circumferential direction. Further, number indication plates 24 indicating numbers of 0, 00, and 1 to 36 as patterned characters in a one-to-one correspondence with the ball reception portions 23 are formed on the top face of the rotating circumferential section 20 in the outer direction of the ball reception portions 23. The roulette wheel 12 is described later in detail.

The support base 13 is a base having a roughly rectangular shape formed by combining a plurality of metal pillars for fixing the roulette wheel 12 at a predetermined height by a total of four fixing members 41 provided at the corners of the top face.

The compressor 14 is a device placed in an internal space formed in the support base 13 for taking in surrounding air and compressing the taken-in air to a predetermined pressure (in the embodiment, 1 Mpa). The compressor 14 according to the embodiment includes an ejection nozzle 42 for ejecting the compressed air, and the air tube 16 is connected to the ejection nozzle 42.

The air tube 16 is a tube for transporting the air compressed by the compressor 14 to a rotation ejection nozzle 36 formed in the roulette wheel 12, and the on-off valve 18 is provided at the intermediate point of the air tube 16, as mentioned above.

The on-off valve 18 is an electromagnetic valve and has a structure to enable the valve open time to be adjusted. The on-off valve 18 is connected to a main control CPU 80 described later for controlling the whole roulette gaming machine 1 (see FIG. 13), and the main control CPU 80 controls the open/closed time period and timing of the valve as described later in accordance with a program previously stored in ROM 81, whereby an operation sequence for adjusting the air pressure ejected from the rotation ejection nozzle 36, rolling the ball 11 on the roulette wheel 12, and storing the ball in any ball reception portion 23 after the expiration of a predetermined time is performed.

When the roulette board 2 is installed in the roulette gaming machine 1, the upper whole of the roulette wheel 12 is covered with a hemispherical cover member 25 made of transparent acryl resin (see FIG. 1), whereby the ball 11 rolling on the roulette wheel 12 during a game can be held so that it does not rush out into the outside of the roulette wheel 12. A foreign substance, etc., is prevented from entering the roulette wheel 12 and a fraudulent practice, etc., is prevented.

Figure 3:
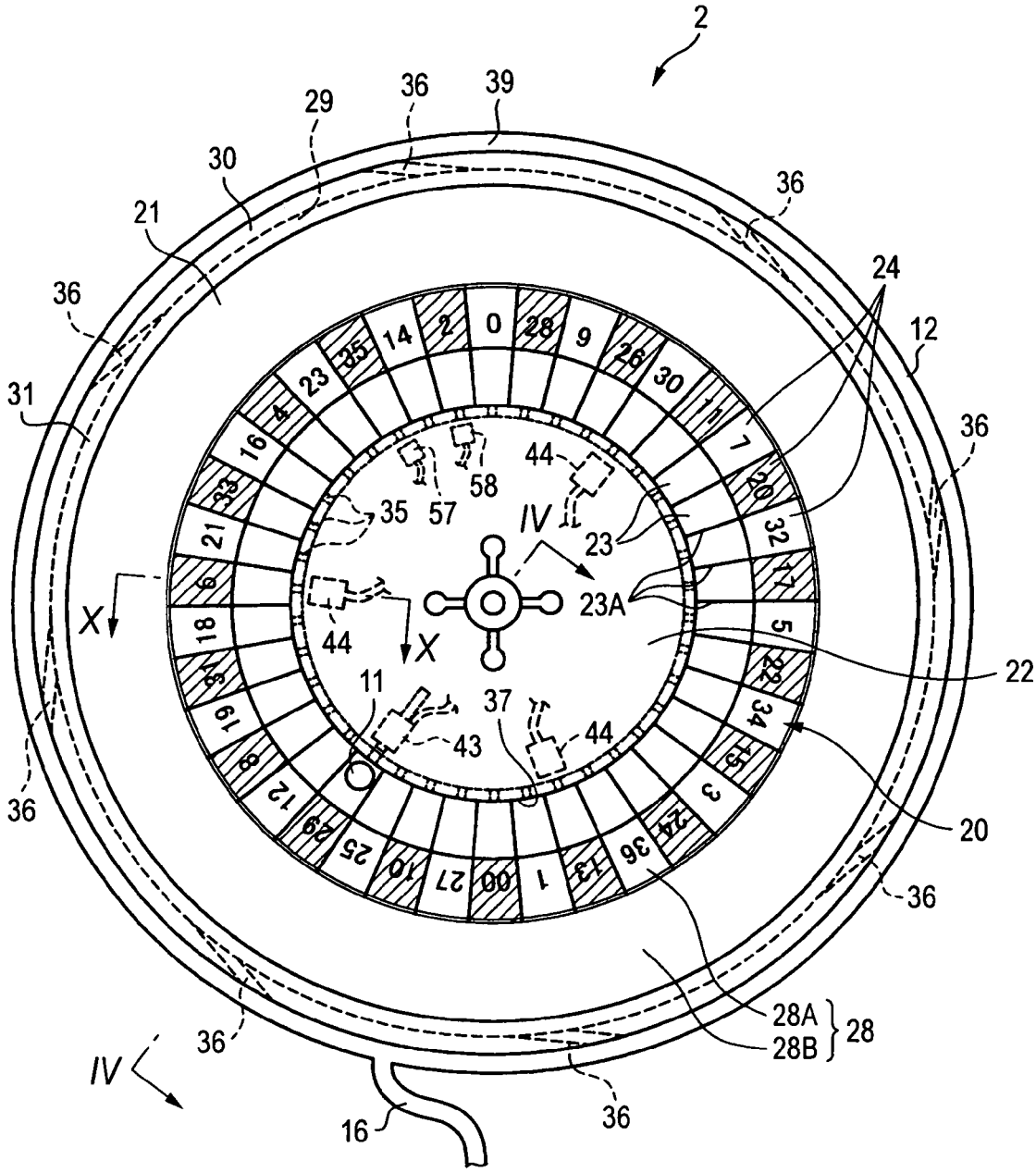
FIG. 3 is a plan view to show the roulette board according to the embodiment.
Figure 4:
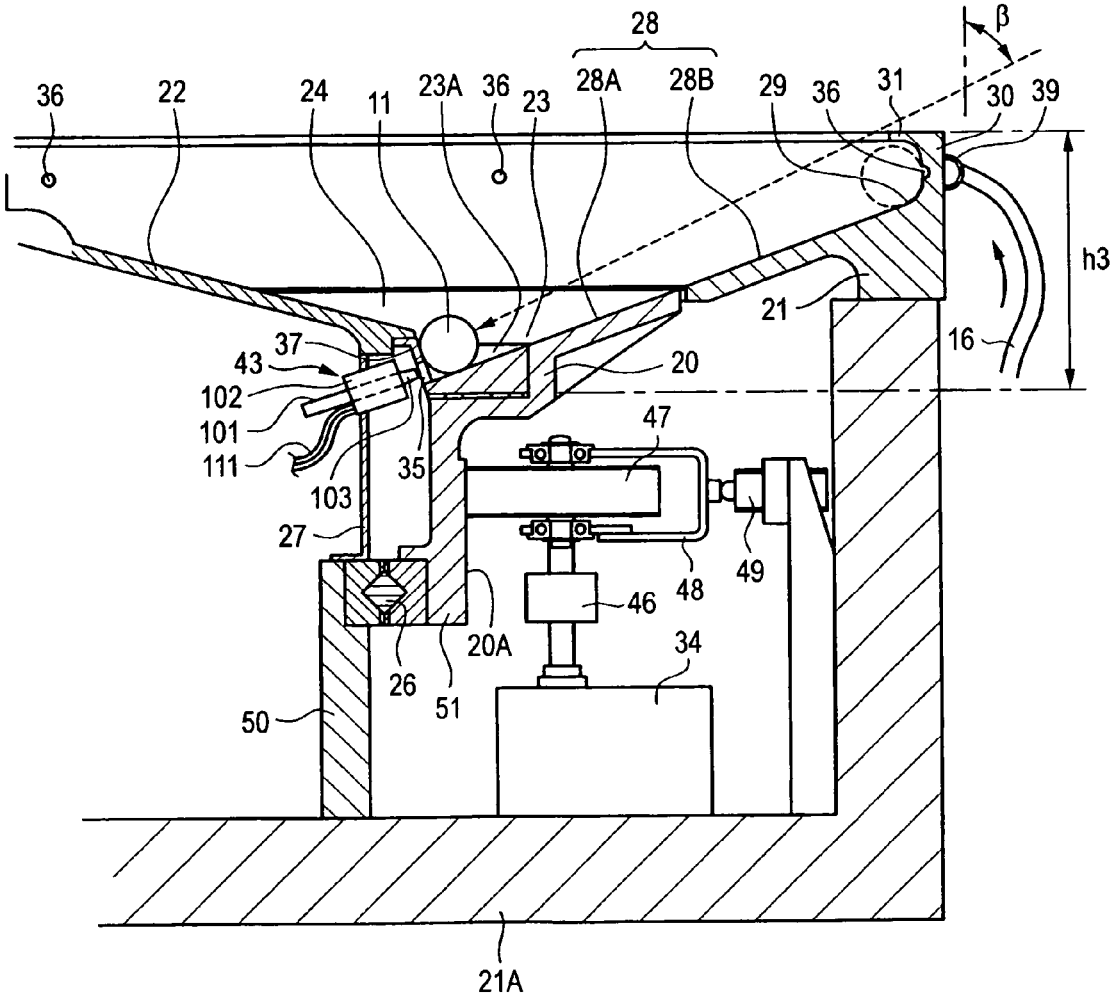
FIG. 4 is a sectional view taken on line IV-IV of the roulette board in FIG. 3.
Figure 5:
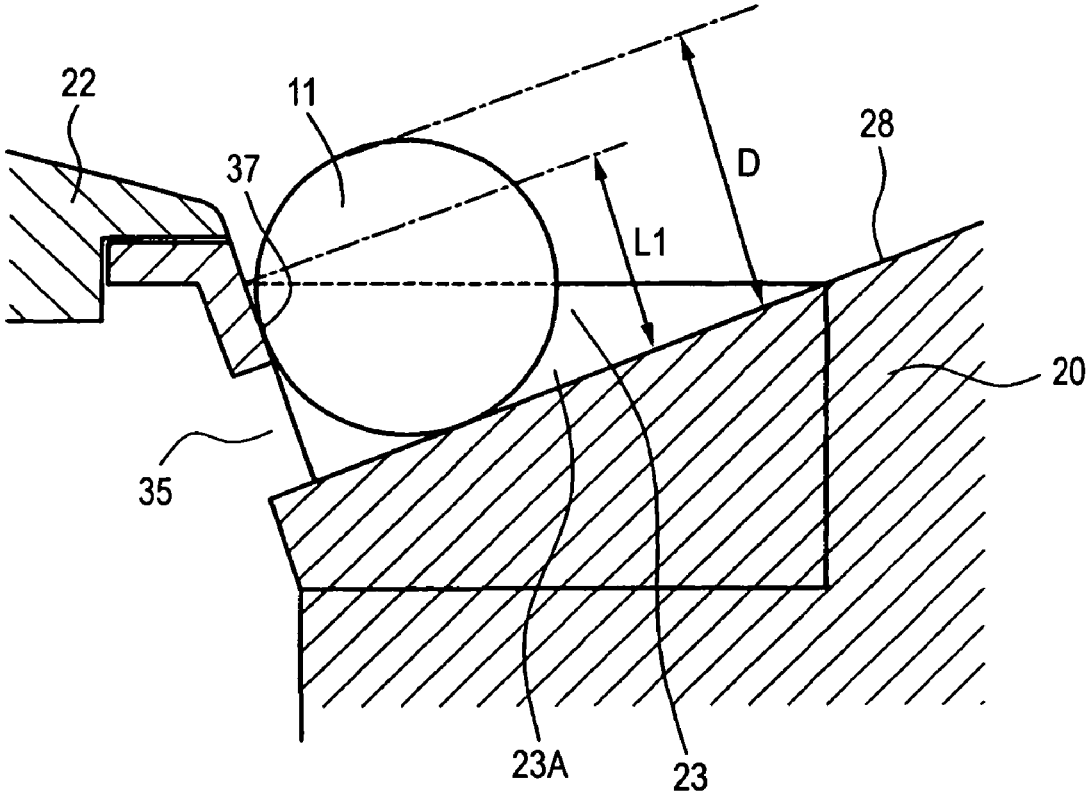
FIG. 5 is a schematic drawing of an enlarged view particularly in the vicinity of a ball reception portion in FIG. 4.

Subsequently, the roulette wheel 12 according to the embodiment will be discussed in detail with FIGS. 3 to 5. FIG. 3 is a plan view to show the roulette board according to the embodiment, FIG. 4 is a sectional view taken on line IV-IV of the roulette board in FIG. 3, and FIG. 5 is a schematic drawing of an enlarged view particularly in the vicinity of the ball reception portion 23 in FIG. 4.

The roulette wheel 12 includes the frame 21 fixed to the support base 13, the fixed center section 22 fixed and supported inside the frame 21, and the annular rotating circumferential section 20 provided surrounding the fixed center section 22, as described above. As shown in FIG. 4, the rotating circumferential section 20 is supported for rotation via a cross ball bearing 26 relative to the fixed center section 22 and is rotated by a drive motor 34 provided in the roulette board 2 at predetermined speed (for example, $2\pi$ [rad/s]) in a predetermined direction (for example, clockwise) relative to the frame 21 from the discharging preparation start time of the ball 11 to the expiration of a predetermined time after the ball 11 is received in any ball reception portion 23 (see FIG. 17). Particularly, to discharge the ball 11 after the expiration of the bet period, the rotating circumferential section 20 is rotated so that the ball reception portion 23 wherein the ball 11 is received at present comes to the front position of a ball discharging unit 43 (described later) fixed to the fixed center section 22. On the other hand, to detect the ball reception portion 23 wherein the ball 11 is received after the termination of ball rolling, the rotating circumferential section 20 is rotated so that the ball reception portion 23 wherein the ball 11 is received at present passes through the front of a ball detection sensor 44 (described later) fixed to the fixed center section 22. Specific rotation drive mechanism and rotation operation of the rotating circumferential section 20 are described later in detail.

A banked passage 29 is formed in the outer peripheral portion of the frame 21. The banked passage 29 is a passage for guiding the ball 11 against the centrifugal force of the ball 11 rolling on the roulette wheel 12 and causing the ball 11 to roll in circumferential orbit. The banked passage 29 is formed like an endless shape relative to the roulette wheel 12 by a guide wall 30 provided upright in the vertical direction and further a wall part 31 continuous with the banked passage 29 is formed at the upper end of the outer peripheral portion. The wall part 31 is a member for urging the ball 11 to the inside so that the ball 11 making rotational motion on the banked passage 29 does not rush out into the outside of the roulette wheel 12.

The ball 11 whose rolling is started by the ball discharging unit 43 (described later) is given an accelerating force by air ejected from the rotation ejection nozzle 36 in the circumferential direction and then increases gradually in speed and makes rotational motion along the banked passage 29. On the other hand, when ejection of the air from the rotation ejection nozzle 36 is stopped, the rotation speed of the ball 11 weakens and the centrifugal force is lost and the ball 11 rolls down on a slope 28, goes to the inside of the roulette wheel 12, and arrives at the rotating rotating circumferential section 20. The ball 11 rolling into the rotating circumferential section 20 rolls on the number indication plate 24 of the rotating rotating circumferential section 20 and is received in any ball reception portion 23. The number indicated on the number indication plate 24 corresponding to the ball reception portion 23 in which the ball 11 is received becomes the win number.

A depth L1 of the ball reception portion 23 relative to the slope 28 is formed so as to become shallower than a diameter D of the ball 11, as shown in FIG. 5.

A total of 38 ball reception portions 23 are separated by partition walls 23A in the circumferential direction to receive the ball 11, as described above. Since the depth L1 of the ball reception portion 23 is formed so as to become shallower than the diameter D of the ball 11, as shown in FIG. 5, it is not feared that the ball 11 will be buried in the ball reception portion 23 when the ball 11 is received in the ball reception portion 23, and the player can easily recognize the position of the ball 11 received in the ball reception portion 23 during the game. Therefore, game play amusement is improved.

Each ball reception portion 23 and the banked passage 29 are formed continuously in the presence of the slope 28 rising at a predetermined inclination angle from the ball reception portion 23 to the banked passage 29, so that it becomes easy for the player to recognize the ball 11 received in the ball reception portion 23.

Figure 6:
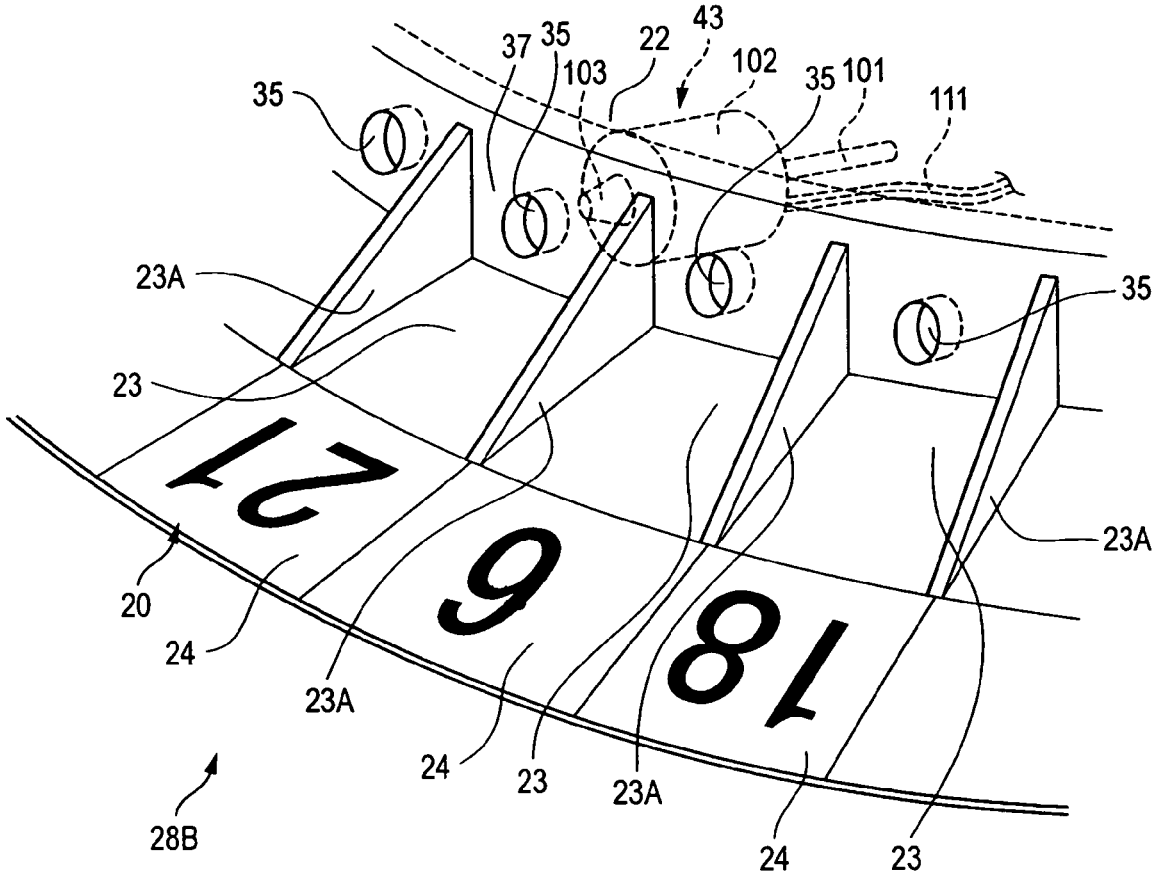
FIG. 6 is a perspective view to show the ball reception portion vicinity of the roulette board according to the embodiment on an enlarged scale.
Figure 7:
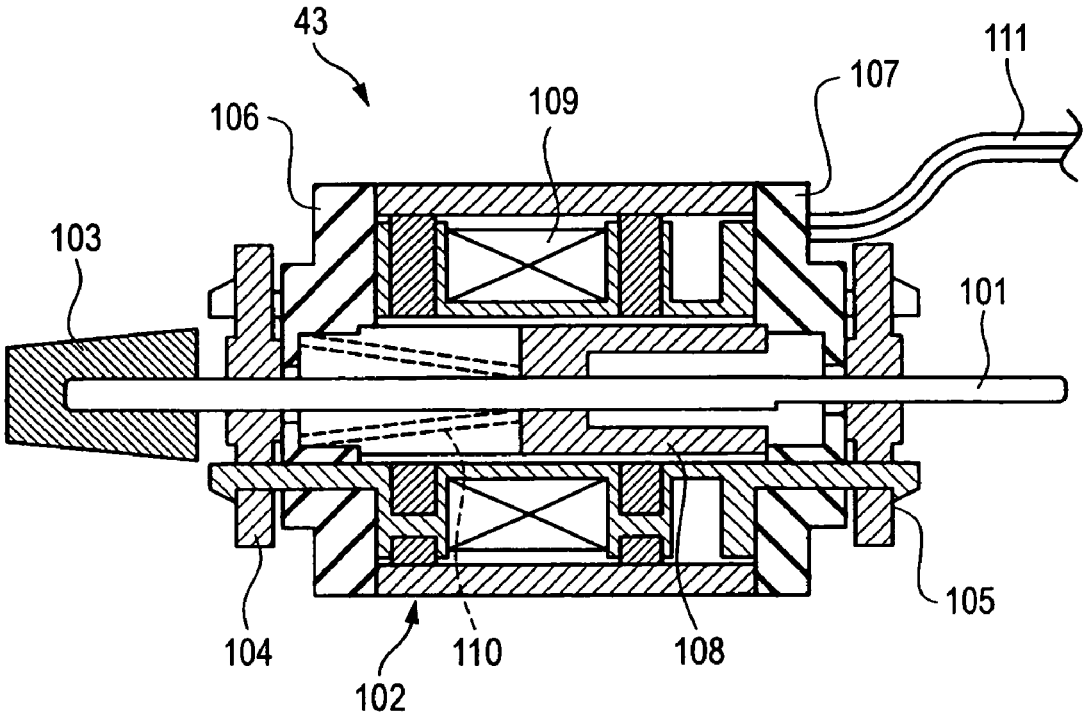
FIG. 7 is a schematic drawing to show the internal structure of a ball discharging unit according to the embodiment.

Next, the ball discharging unit 43 of one of rolling means for rolling the ball 11 on the roulette wheel 12 will be discussed with FIGS. 6 to 8B. FIG. 6 is a perspective view to show the ball reception portion vicinity of the roulette board 2 according to the embodiment on an enlarged scale, FIG. 7 is a schematic drawing to show the internal structure of the ball discharging unit 43 according to the embodiment, and FIG. 8 is a schematic drawing to show the discharging mechanism of the ball 11 by the ball discharging unit 43.

To roll the ball 11 once received in the ball reception portion 23 onto the roulette wheel 12, the roulette board 2 according to the embodiment uses the ball discharging unit 43 with a solenoid 102 as a drive source as means for discharging the ball 11.

The ball discharging unit 43 (ball discharging mechanism) is fixedly supported by a fix board 27 in the outer circumference of the fixed center section 22 particularly opposed to the rotating circumferential section 20, as shown in FIGS. 4 and 6. On the other hand, an inner wall 37 forming each ball reception portion 23 together with the partition wall 23A is formed with a rod passage hole (through hole) 35 shaped like a circle. In the embodiment, the 38 ball reception portions 23 are formed in a one-to-one correspondence with the numbers of 0, 00, and 1 to 36 and therefore 38 rod passage holes 35 are formed in total.

Given power is supplied from a solenoid drive circuit 85 (see FIG. 13) to the solenoid 102 forming a part of the ball discharging unit 43, whereby a distal portion 103 of a rod 101 (ball discharging member) of a rod member supported in the solenoid 102 is moved toward the direction of the ball reception portion 23 positioned at the front of the ball discharging unit 43 as shown in FIG. 6 (in the figure, the ball reception portion 23 with the number 21). The rod 101 is allowed to pass through the rod passage hole 35 made in the inner wall 37 and the ball 11 is discharged toward the direction of the banked passage 29 by the collision force produced by colliding the rod 101 with the ball 11 in the ball reception portion 23. Consequently, the ball 11 received in the ball reception portion 23 starts to roll toward the direction of the banked passage 29 against the inclination of the slope 28.

The internal structure of the ball discharging unit 43 will be discussed with FIG. 7. The ball discharging unit 43 includes the above-mentioned solenoid 102 forming a magnetic circuit, a front bearing plate 104 and a rear bearing plate 105 joined to the front and rear ends of the solenoid 102, a front buffer plate 106 and a rear buffer plate 107 interposed between the solenoid 102 and the front bearing plate 104 and the rear bearing plate 105, the above-mentioned rod 101 supported so as to be able to reciprocate relative to the solenoid 102 (namely, relative to the roulette wheel 12 where the solenoid 102 is fixed), and a spring 110 for urging the rod 101 to the rear.

Figure 13:
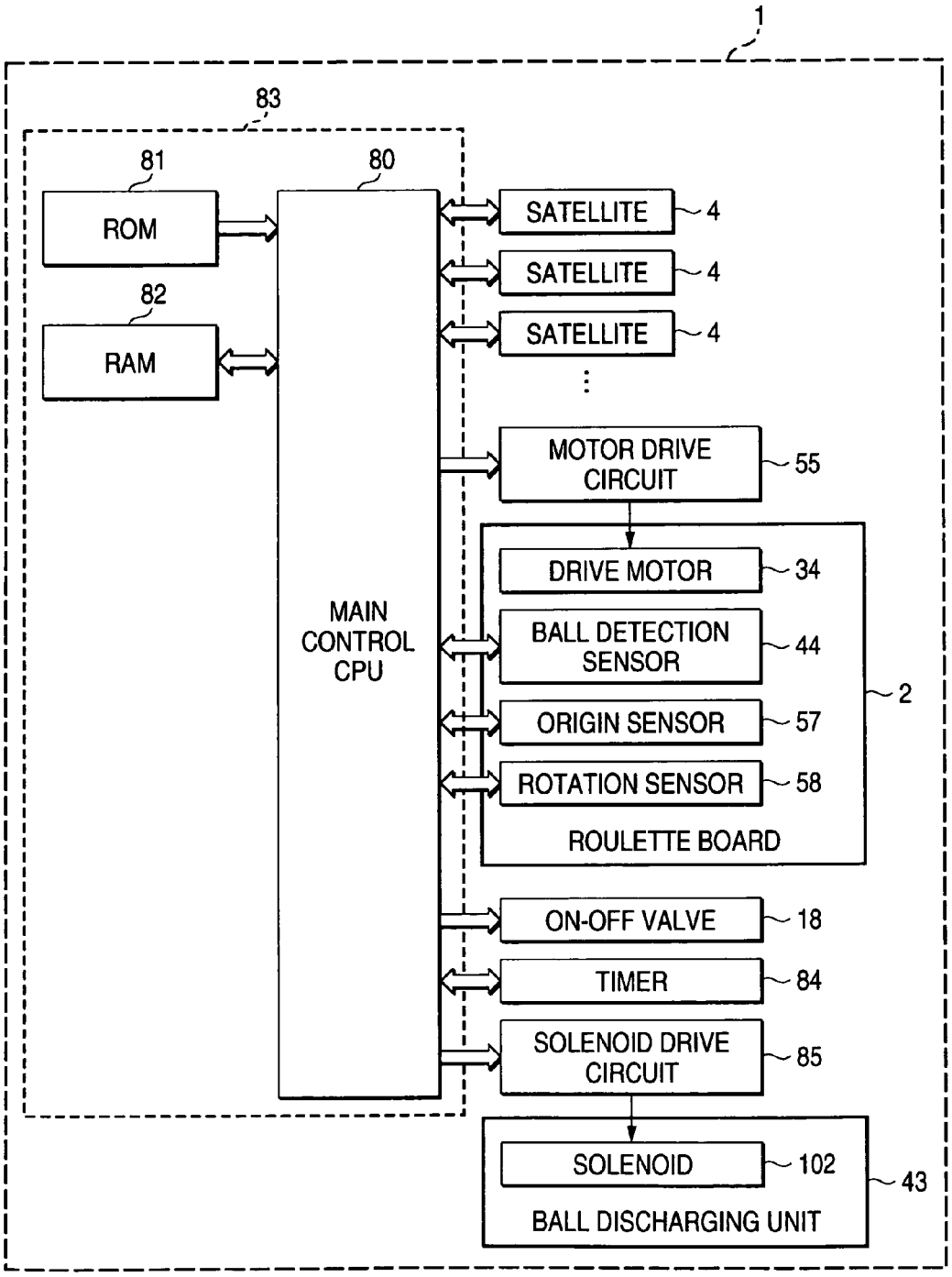
FIG. 13 is a block diagram to schematically show a control system of the roulette gaming machine according to the embodiment.

The solenoid 102 is provided with a coil 109 attached to a supply cable 111 for supplying power from the solenoid drive circuit 85 (see FIG. 13). Further, the solenoid 102 is provided with a rod 101 that is integral with a plunger 108 for moving based on a magnetic field generated as an electric current is allowed to flow into the coil 109.

In the described ball discharging unit 43, when given power is supplied from the solenoid drive circuit 85 via the supply cable 111 to the solenoid 102, a magnetic field is generated inside the coil 109. The magnetic field causes the plunger 108 to be attracted to the coil 109 for moving the distal portion 103 of the rod 101 to an advance position (moving from the position shown in FIG. 8A to the position shown in FIG. 8B). Consequently, the rod 101 passes through the rod passage hole 35 made in the inner wall 37 and collides with (comes in contact with) the ball 11 received in the ball reception portion 23 and the ball 11 is discharged toward the direction of the banked passage 29 by the collision force.

Figure 8A:
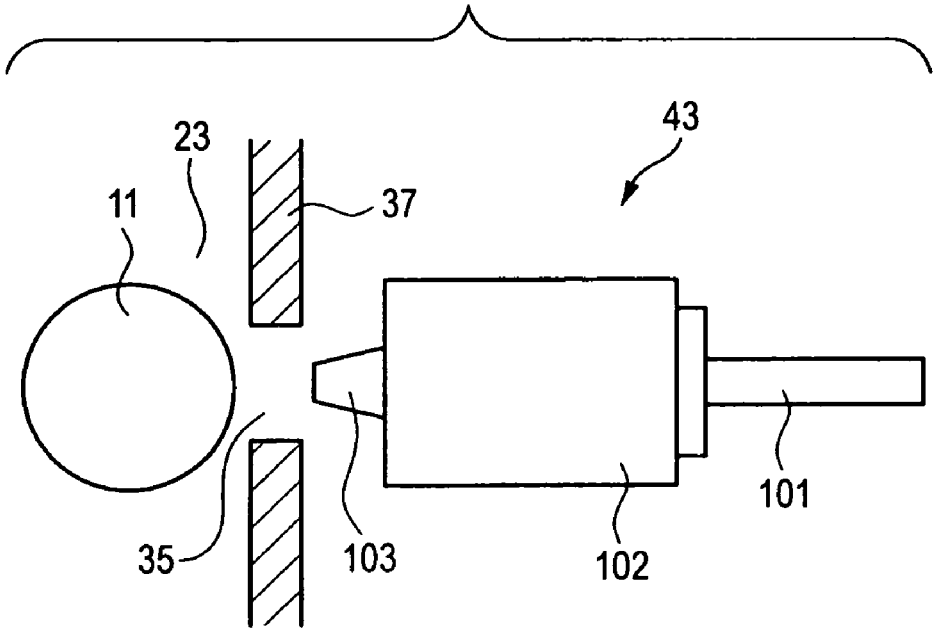
FIG. 8A is a schematic drawing to show the ball discharging unit when power supply to a solenoid is stopped.
Figure 8B:
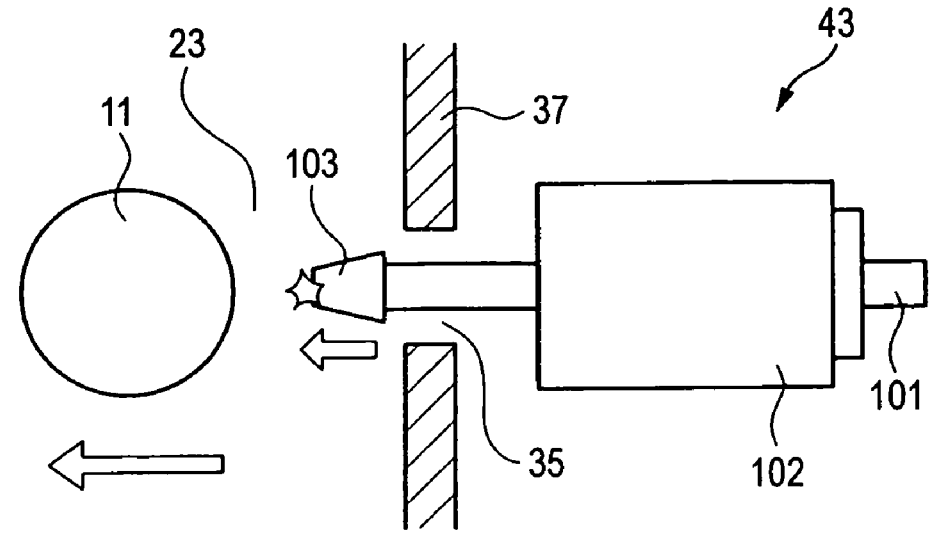
FIG. 8B is a schematic drawing to show the ball discharging unit when power is supplied to the solenoid.

On the other hand, when power supply from the solenoid drive circuit 85 is stopped, the solenoid 102 releases the plunger 108 of the rod 101 and the spring 110 presses the plunger 108 of the rod 101, thereby moving the rod 101 to a retract position (moving from the position shown in FIG. 8B to the position shown in FIG. 8A).

As the operation is repeated, the rod 101 is reciprocated between the advance position and the retract position.

Figure 9:
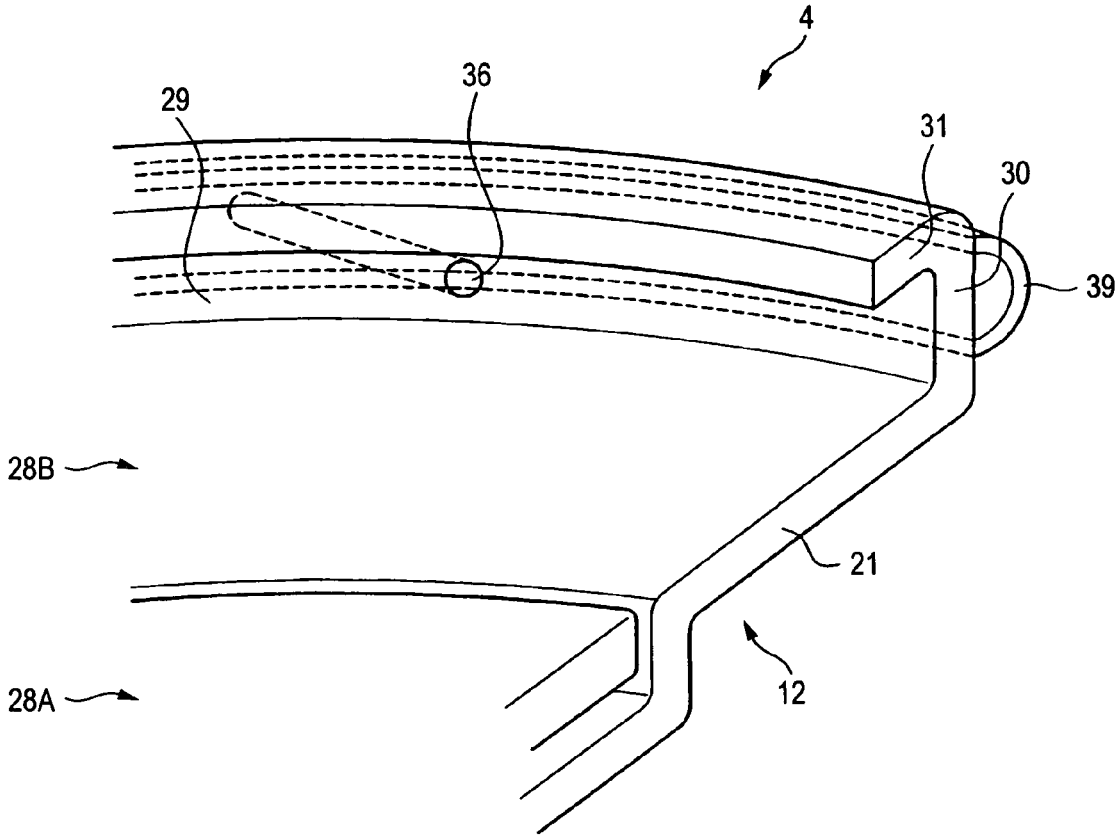
FIG. 9 is a perspective view to show the vicinity of the banked passage of the roulette board according to the embodiment on an enlarged scale.

Subsequently, the rotation ejection nozzle 36 of one of rolling means for rolling the ball 11 on the roulette wheel 12 will be discussed with FIG. 9. FIG. 9 is a perspective view to show the vicinity of the banked passage 29 of the roulette board 2 according to the embodiment on an enlarged scale. To cause the ball 11 discharged by the ball discharging unit 43 to roll on the roulette wheel 12, the roulette board 2 according to the embodiment uses the air pressure of compressed air as a drive source.

The rotation ejection nozzles 36 are made in the guide wall 30 forming a part of the banked passage 29 at predetermined spacings (in the embodiment, at spacings of 45 degrees) as shown in FIG. 9. The rotation ejection nozzles 36 are formed toward the circumferential direction of the banked passage 29, namely, the tangential direction of the roulette wheel 12, and air ejected from each rotation ejection nozzle 36 produces an air layer flowing clockwise along the banked passage 29 of the roulette wheel 12 (see FIG. 21).

On the other hand, an annular rotating air pipe 39 is installed on the back side of the guide wall 30 formed with the rotation ejection nozzles 36. The rotating air pipe 39 is connected to the air tube 16 and air transported from the air tube 16 is allowed to flow into the rotating air pipe 39 and is ejected all at once from the eight rotation ejection nozzles 36.

Accordingly, the ball 11 discharged by the ball discharging unit 43 and rolling to the banked passage 29 starts to roll clockwise by the action of the air layer flowing circularly along the banked passage 29.

If ejection of air from the rotation ejection nozzles 36 is stopped, the air layer formed along the banked passage 29 disappears and the rotation speed of the ball 11 gradually grows weak and the centrifugal force is lost. Then, the ball 11 rolls down along the inclination of the slope 28, goes to the inside of the roulette wheel 12, and arrives at the rotating rotating circumferential section 20. The ball 11 is received in any of the ball reception portions 23 formed on the rotating circumferential section 20. Accordingly, the win number of the roulette board 2 is determined and the roulette gaming machine 1 pays out medals to the player based on the determined number and bet information of the player and terminates the game.

When power is again supplied to the solenoid 102 of the ball discharging unit 43 for driving, the ball 11 received in the ball reception portion 23 again starts to roll and it is made possible to play another game successively without collecting the ball 11.

As described above, it is made possible to add a force to the ball 11 by the ball discharging unit 43 and the air pressure of air ejected from the rotation ejection nozzles 36 and repeat rolling the ball 11 and storing the ball 11 in any ball reception portion 23 without collecting the ball 11 from the roulette wheel 12. Therefore, the complicated mechanism of moving parts and the like, for collecting the ball 11 and a discharging unit, etc., is not required, the maintenance work is facilitated, and the apparatus cost can be reduced.

Since the complicated mechanism of moving parts and the like, for collecting the ball 11 and a discharging unit, etc., is not required, the depth L1 of the ball reception portion 23 can be made shallower than the diameter D of the ball 11 (see FIG. 5). Accordingly, it is made possible to decrease a height "h3" of the roulette wheel 12 as shown in FIG. 4. Therefore, viewing angle β of the roulette board 2 for recognizing the ball 11 can be widened and it becomes easy for the player to recognize the ball 11, leading to improvement of game play amusement.

Further, each ball reception portion 23 and the banked passage 29 are formed continuously in the presence of the slope 28 rising at the predetermined inclination angle from the ball reception portion 23 to the banked passage 29, so that it becomes easy for the player to recognize the ball 11 received in the ball reception portion 23.

Figure 10:
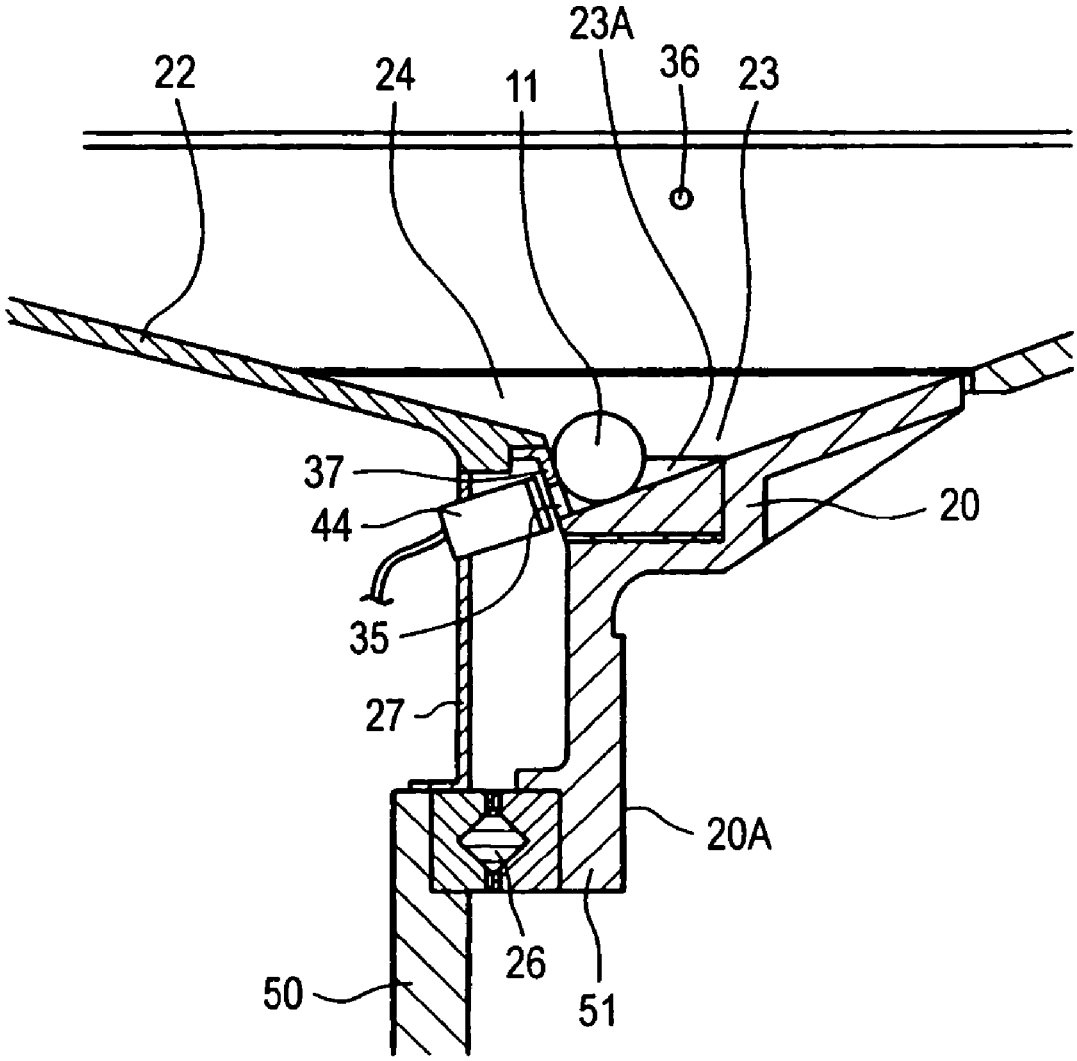
FIG. 10 is a sectional view taken on line X-X of the roulette board in FIG. 3.

Next, various sensors, such as the ball detection sensors 44, provided in the fixed center section 22 of the roulette wheel 12 will be discussed with reference to FIGS. 3 and 10. FIG. 10 is a sectional view taken on line X-X of the roulette board 2 shown in FIG. 3.

The roulette board 2 according to the embodiment is provided with the ball detection sensors 44 for detecting the ball reception portion 23 in which the ball 11 is received as well as the ball discharging unit 43 brought into contact with (collided with) the ball 11 for discharging the ball 11 to the fixed center section 22 not rotated during the game.

The ball detection sensors 44 are fixedly supported by the fix board 27 in the outer circumference of the fixed center section 22 particularly opposed to the rotating circumferential section 20, as shown in FIGS. 3 and 10. The ball detection sensor 44 is a reflection-type optical sensor and includes a light emission element for emitting an infrared light and a light reception element for receiving the infrared light. If an obstacle exists within a predetermined distance, the ball detection sensor 44 can detect the presence and the position of the obstacle. Therefore, the ball detection sensor 44 can detect the ball 11 received at a predetermined position (position at a distance of 3 cm) in the ball reception portion 23 positioned at the front of the ball detection sensor 44 through the rod passage hole 35. The ball detection sensor 44 may be a transmission-type optical sensor, in which case a light emission element is installed in the fixed center section 22 and a light reception element is installed at a position of the banked passage 29 opposed to the light emission element. Accordingly, if the ball 11 exists in the ball reception portion 23 positioned between the light emission element and the light reception element, the ball detection sensor 44 can detect the ball 11.

In the roulette board 1 according to the embodiment, the ball detection sensor 44 is not limited to the use of the reflection-type optical sensor. The ball detection sensor 44 may be configured as arbitrary optical sensor that detects the ball based on a light received through the through hole.

The fixed center section 22 is provided with an origin sensor 57 and a rotation sensor 58 in addition to the ball detection sensors 44. Like the ball detection sensors 44 and the ball discharging unit 43, the origin sensor 57 and the rotation sensor 58 are fixedly supported by the fix board 27 in the outer circumference opposed to the rotating circumferential section 20.

The origin sensor 57 is a sensor for detecting the ball reception portion 23 positioned at the front of the origin sensor 57 is the ball reception portion 23 at what position relative to the origin (reference position). The rotation sensor 58 is a sensor for detecting whether or not the rotating circumferential section 20 rotates.

Specifically, while the rotation sensor 58 detects that the rotating circumferential section 20 rotates, the origin sensor 57 detects the projections and depressions of an identification plate (not shown) having an uneven pattern added to the back of the inner wall 37 of each ball reception portion 23 (the side opposed to the origin sensor 57), thereby always detecting the ball reception portion 23 positioned at the front of the origin sensor 57 at present is at what position relative to the ball reception portion 23 associated with "00" of the origin. For example, the origin sensor 57 detects that the ball reception portion 23 positioned at the front of the origin sensor 57 at the point in time shown in FIG. 3 (the ball reception portion associated with "35") is the ball reception portion 23 at the 16th position to the right from the ball reception portion 23 associated with "00."

Therefore, the origin sensor 57 detects the ball reception portion 23 positioned at the front of the origin sensor 57 is at what position relative to the ball reception portion 23 associated with "00" at the timing at which the ball detection sensor 44 detects the ball 11. It is made possible to calculate the ball reception portion 23 with the ball 11 detected by the ball detection sensor 44 is at what position relative to the ball reception portion 23 associated with "00" based on the detection result. Accordingly, the number associated with the ball reception portion 23 with the ball 11 detected by the ball detection sensor 44 (0, 00, 1 to 36), namely, the win number can be determined (S16 in FIG. 18). The origin (reference position) need not be the ball reception portion 23 associated with "00" and may be any other ball reception portion 23.

Figure 18:
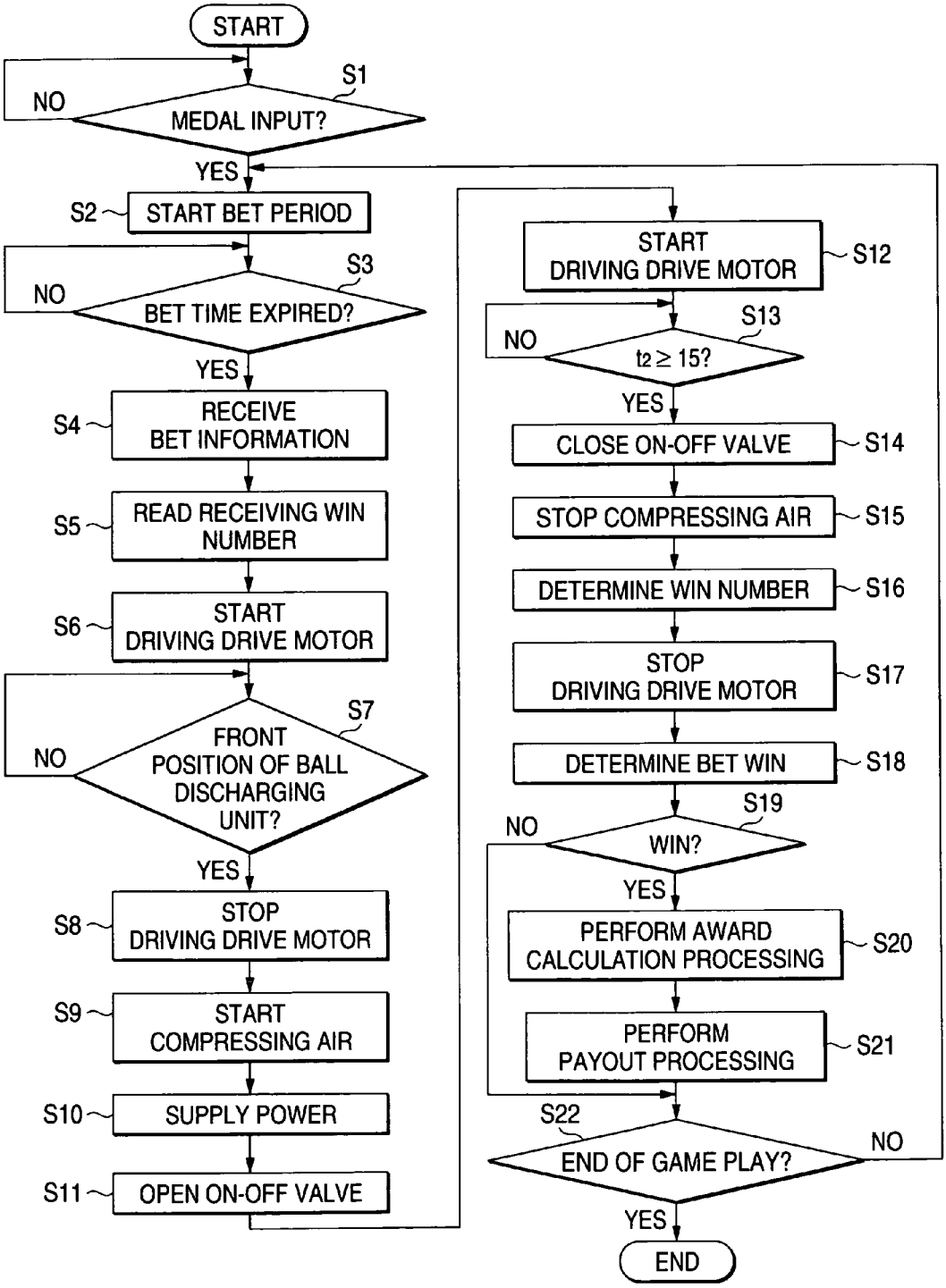
FIG. 18 is a flowchart of a usual roulette game processing program according to the embodiment.

When the ball 11 is discharged at the game play start time, it is made possible to determine whether or not the ball reception portion 23 in which the ball 11 is received is positioned at the front of the ball discharging unit 43 based on the win number of the preceding game and the detection result indicating the ball reception portion 23 positioned at the front of the origin sensor 57 is at what position relative to the ball reception portion 23 associated with "00." The drive motor 34 is controlled based on the determination result, whereby the ball reception portion 23 in which the ball 11 is received is positioned at the front of the ball discharging unit 43 (position where the rod 101 and the ball 11 in the ball reception portion come in contact with each other) and it is made possible to discharge the ball 11 (S6 to S8 in FIG. 18).

As described above, in the roulette gaming machine 1 according to the embodiment, the rotating circumferential section 20 is rotated at least one-third of a round after the ball 11 is received in the ball reception portion 23, whereby any ball detection sensor 44 passes through in front of all ball reception portions 23. The detection result of the origin sensor 57 at the detection timing of the ball 11 is transmitted to the main control CPU 80 (described later with reference to FIG. 13). The main control CPU 80 determines the win number based on the detection result.

When the ball is discharged, the drive motor 34 (described later) is controlled so that the ball reception portion 23 corresponding to the win number in the preceding game is positioned at the front of the ball discharging unit 43 (position where the rod 101 and the ball 11 in the ball reception portion come in contact with each other), and power is supplied to the solenoid 102, whereby it is made possible to discharge the ball 11 from the ball reception portion 23.

Figure 11:
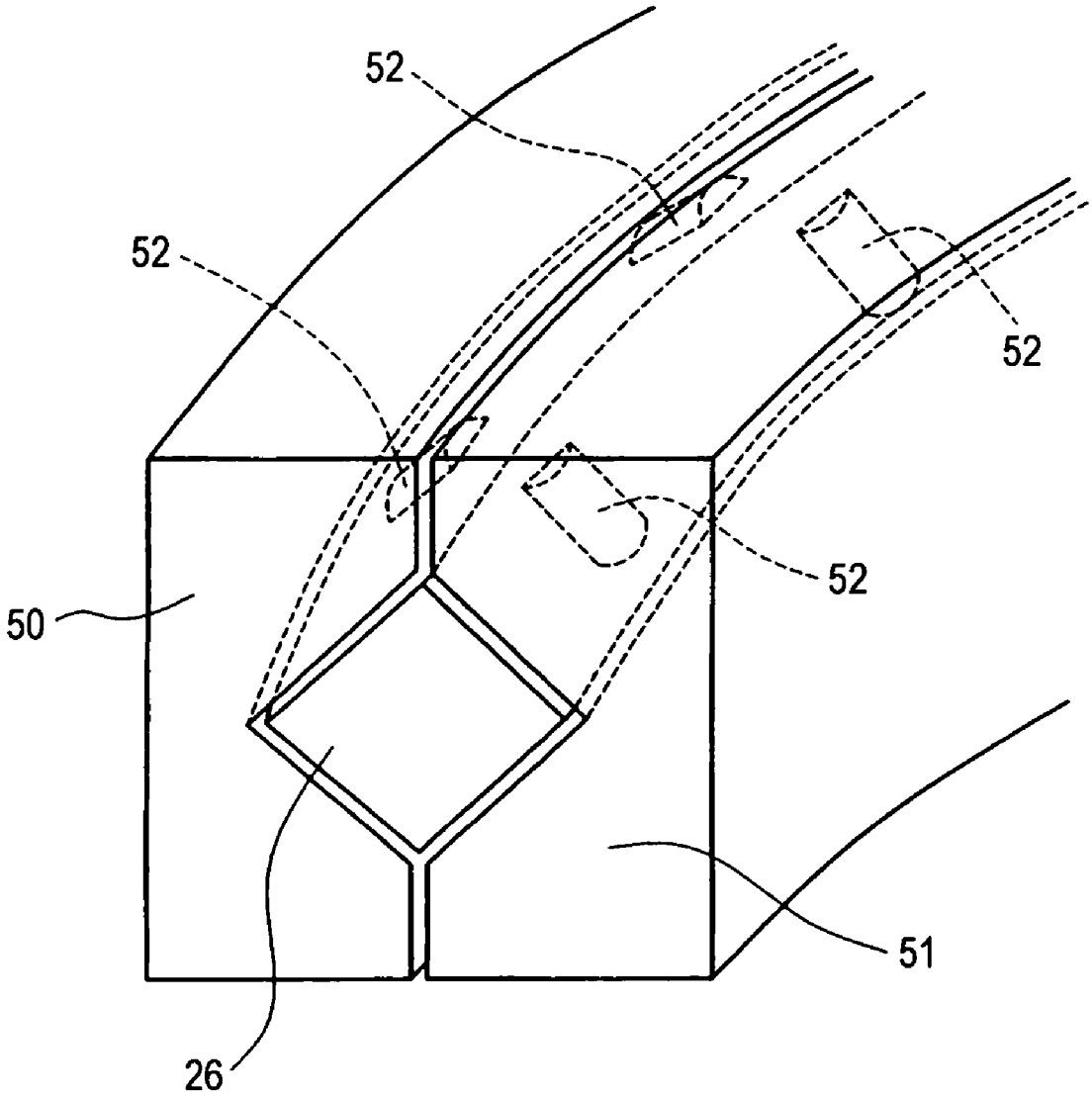
FIG. 11 is a schematic drawing to show a cross ball bearing for supporting a rotating circumferential section for rotation relative to a fixed center section in the roulette board according to the embodiment as the cross ball bearing is cut at a predetermined position.

Next, the rotation drive mechanism of the rotating circumferential section 20 relative to the fixed center section 22 of the roulette wheel 12 will be discussed with FIGS. 4 and 11. FIG. 11 is a schematic drawing to show the cross ball bearing 26 for supporting the rotating circumferential section 20 for rotation relative to the fixed center section 22 in the roulette board 2 according to the embodiment as the cross ball bearing 26 is cut at a predetermined position.

As shown in FIG. 4, the drive motor 34 is fixed to a bottom plate 21A of the frame 21. The drive motor 34 is a stepping motor that can be rotated in step units determined with no feedback by giving a pulse signal. Therefore, the rotation angle and the rotation speed of the drive motor 34 are determined by the number of times and the period of the pulse signal given to the drive motor 34 and further as the pulse signal is stopped, the drive motor 34 stops with the rotation angle held at the point in time.

A drive roller 47 is attached to the drive motor 34 through a drive shaft 46 and further is abutted against a side 20A of the rotating circumferential section 20. Therefore, when the drive motor 34 is driven, the drive roller 47 also rotates with rotation of the drive motor 34 and further the rotating circumferential section 20 rotates relative to the fixed center section 22 by friction with the drive roller 47. The drive roller 47 is stored in a roller case 48 having an angular U shape and further the roller case 48 is urged by a given force in the direction of the side 20A by an urging member 49 provided on the outer periphery side of the drive roller 47. Therefore, the drive roller 47 and the side 20A of the rotating circumferential section 20 are placed in a state in which they are abutted against each other based on adequate pressure at all times, and it is not feared that load than is necessary will be imposed on the drive roller 47 or that the drive roller 47 will run idle.

As shown in FIGS. 4 and 11, a fixed side inner wall section 50 of the fixed center section 22 and a moving side inner wall section 51 of the rotating circumferential section 20 opposed to the fixed side inner wall section 50 are connected by the cross ball bearing 26.

The cross ball bearing 26 is an annular member roughly quadrangular in cross section and 30 to 40 bearings are attached to each of the four sides as shown in FIG. 11. Accordingly, the moving side inner wall section 51 is configured to be moveable relative to the fixed side inner wall section 50 fixed to the frame 21, and the rotating circumferential section 20 is supported for rotation relative to the fixed center section 22.

Therefore, the rotating circumferential section 20 is configured to be rotatable at a predetermined angle relative to the fixed center section 22 based on the rotation direction and the rotation angle of the drive motor 34 driven by a pulse signal and accordingly the ball reception portion 23 positioned at the front of the ball discharging unit 43 and the ball detection sensor 44 is changed to any desired ball reception portion 23. Accordingly, it is made possible to detect the ball reception portion 23 in which the ball 11 is received and discharge the received ball 11. The drive motor 34 is connected through a motor drive circuit 55 to the main control CPU 80 (see FIG. 13) and is controlled as described later based on a program stored in a storage such as ROM.

Next, the configurations of the control section 6 and the image display 7 according to the embodiment will be discussed. The control section 6 is provided on the side of the image display 7 and buttons operated by the player are placed, as shown in FIG. 1. Specifically, a BET confirmation button 62, a payback (CASHOUT) button 63, and a help (HELP) button 64 are placed from the left to the right viewed from the position opposed to the satellite 4.

The BET confirmation button 62 is a button pressed by the player to confirm the bet after bet operation with the image display 7 described later. If the bet is confirmed and the player has bet a medal on the number described on the number indication plate 24 corresponding to the ball reception portion 23 in which the ball 11 is received in the roulette board 2 during the game, the player wins the game. If the player wins the game, the credit points responsive to the number of the bet chips are added to the current owned credit points of the player. The bet operation is described later in detail.

The payback button 63 is a button usually pressed by the player when terminating the game. When the player presses the payback button 63, medals responsive to the current owned credit points of the player, gained by the games, etc., (usually, one medal to one credit point) are paid back to the player from the medal payout opening 8.

The help button 64 is a button pressed by the player when the player is unfamiliar with the rules and operations of the game. When the player presses the help button 64, a help screen indicating various pieces of operation information is displayed on the image display 7.

Figure 12:
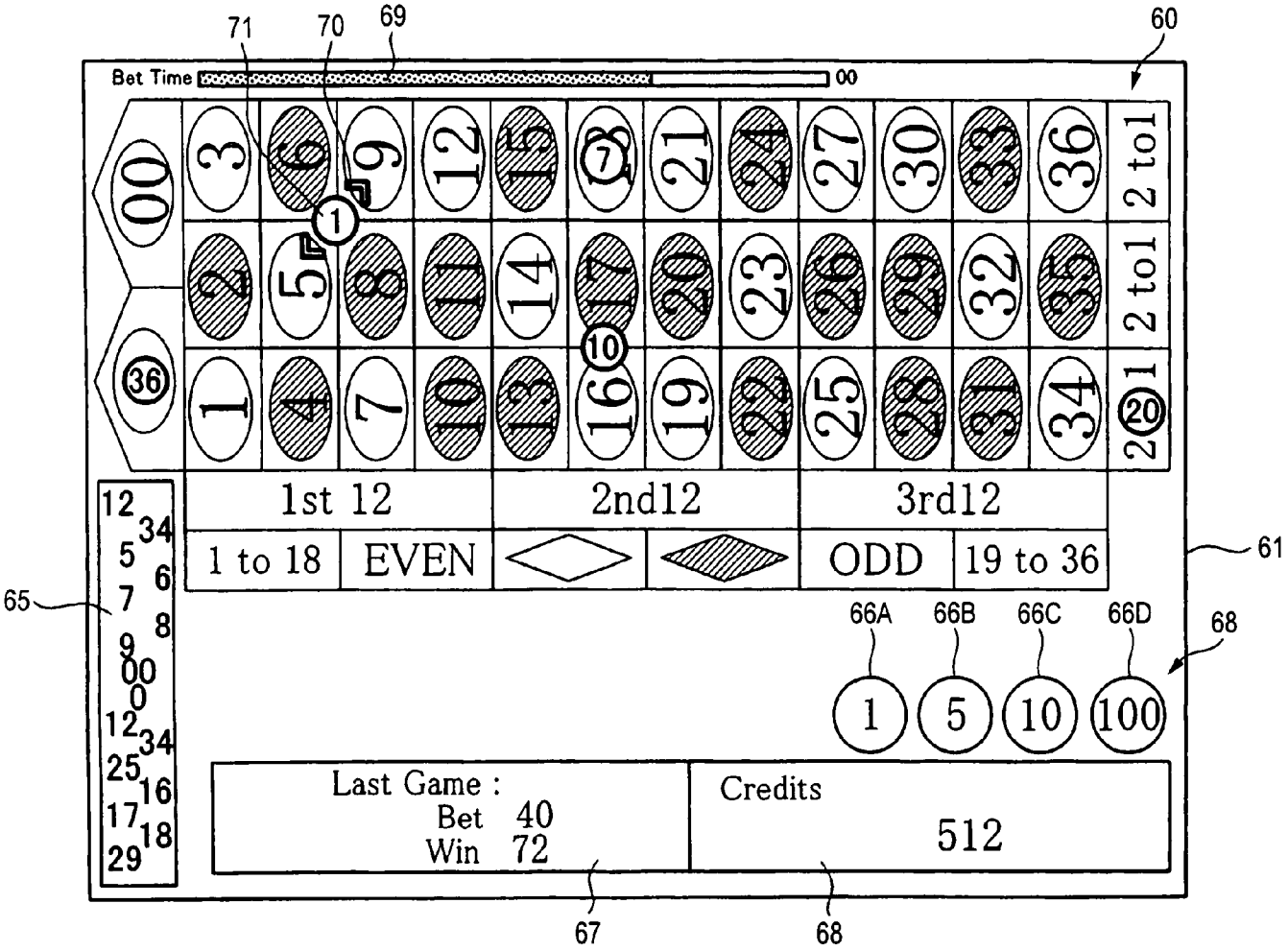
FIG. 12 is a drawing to show an example of a display screen displayed on an image display.

The image display 7 is a so-called touch-panel-type liquid crystal display that is provided with a touch panel 53 attached to the front of the liquid crystal display. The player can press an icon displayed on a liquid crystal screen with a finger, etc., for selecting the icon. FIG. 12 is a drawing to show an example of a display screen displayed on the image display during the game.

As shown in FIG. 12, during the game with the roulette gaming machine 1, the image display 7 displays a BET screen 61 having a table betting board 60. The player operates the BET screen 61 to bet a chip using his or her owned credit.

The BET screen 61 will be discussed below based on FIG. 12: The same numbers as the numbers 0, 00, and 1 to 36 indicated on the number indication plates 24 are arranged like squares on the table betting board 60 displayed on the BET screen 61. Special BET areas for the player to bet a chip by specifying "odd number," "even number," "color of number indication plate (red or black), or "given number range (for example, 1 to 12 or the like)" are also arranged like squares.

Displayed below the table betting board 60 are a result history display section 65, unit BET buttons 66, a payback result display section 67, and a credit count display section 68 from the left to the right of the screen.

The result history display section 65 lists the results of the win numbers in the previous games (one game refers to an operation sequence from the player betting a chip at each satellite 4 to the ball 11 dropping to the ball reception portion 23 to paying out credit based on the win number). When one game is over, a new win number is added to the top of the result history display section 65 for display and the player can check the history of the win numbers of a maximum of 16 games.

The unit BET buttons 66 are buttons for betting chips on a BET area (on a square where the symbol is placed or on a line that forms the square) specified by the player. The unit BET buttons 66 include 1-BET button 66A, 5-BET button 66B, 10-BET button 66C, and 100-BET button 66D.

The player first specifies the BET area with a cursor 70 described later by directly pressing the screen with a finger, etc. In this state, if the player presses the 1-BET button 66A, the player bets one chip at a time (the number of bet chips increases from one to two to three to . . . each time the player presses the 1-BET button 66A with a finger, etc.). On the other hand, if the player presses the 10-BET button 66C, the player can bet 10 chips at a time (the number of bet chips increases as such from 10 to 20 and to 30, each time the player presses the 10-BET button 66C with a finger, etc.). The player can also operate the 5-BET button 66B and the 100-BET button 66D in a similar manner. Therefore, to bet a large number of chips, the operation can be simplified.

The payback result display section 67 displays the number of bet chips of the player in the preceding game and the paid-back credit count. Here, subtracting the number of bet chips from the paid-back credit count results in the credit count newly gained by the player playing the preceding game.

Further, the credit count display section 68 displays the credit count owned by the player at present. When the player bets chips, the credit count is decremented by the number of the bet chips (one credit point per chip). If the player wins the game and the corresponding credit points are paid back, the credit count is incremented by the paid-back credit points. If the credit count owned by the player reaches 0, the game is over.

A BET timer graph 69 is provided at the top of the table bettingboard 60. The BET timer graph 69 is a graph for indicating the remaining time during which the player can bet, and a red graph extends gradually to the right with the passage of time from the game start time. When the graph extends to the rightmost side, the time during which the player can bet in the current game expires. If the bet period of the player at each satellite 4 expires, namely, the BET timer graph 69 reaches the rightmost side, the ball discharging unit 43 discharges the ball 11 in the ball reception portion 23 for starting to roll the ball 11.

A cursor 70 indicating the BET area selected by the player at present is displayed on the table betting board 60. A chip mark 71 indicating the number of bet chips and the selected BET area so far is also displayed on the table betting board 60. The number displayed on the chip mark 71 denotes the number of bet chips. For example, the chip mark 71 of 7 placed on the square 18 as shown in FIG. 12 indicates that the player bets seven chips on the number 18. The betting method only on one number is called "straight up."

The chip mark 71 of 1 placed at the intersection of the squares 5, 6, 8, and 9 indicates that the player bets one chip on the four numbers covering 5, 6, 8, and 9. The betting method covering four numbers is called "corner bet."

Other available bet methods are as follows: "Split bet" for betting a chip covering two numbers on the line between the two numbers; "street bet" for betting a chip covering three numbers (for example, 13, 14, and 15) on the end of a horizontal row of the numbers (in FIG. 12, one row in the vertical direction) "five bet" for betting a chip covering five numbers of 0, 00, 1, 2, and 3 on the line between the numbers 00 and 3; "line bet" for betting a chip covering six numbers (for example, 13, 14, 15, 16, 17, and 18) among numbers of two horizontal rows of the numbers (in FIG. 12, two rows in the vertical direction); "column bet" for betting a chip covering 12 numbers on the square written as "2 to 1;" and "dozen bet" for betting a chip covering 12 numbers on the square written as "1st 12," "2nd 12," or "3rd 12." Further, bet methods each covering 18 numbers depending on the number indication plate color (red or black), odd or even number, whether the number is equal to or less than 18 or is equal to or more than 19 using six squares provided at the bottom stage of the table betting board 60 are also available.

To bet a chip on the BET screen 61 described above, first the player specifies the BET area (on a square where the symbol is placed or on a line that forms the square) to bet on the screen and presses the BET area directly with a finger. Consequently, the cursor 70 moves to the specified BET area. Then, whenever the player presses one of the unit BET buttons 66 (1-BET button 66A, 5-BET button 66B, 10-BET button 66C, 100-BET button 66D), as many medals as the number indicated by the unit BET button are bet on the specified BET area. For example, if the player presses the 10-BET button 66C four times, the 5-BET button 66B once, and the 1-BET button 66A three times, a total of 48 medals can be bet.

Next, the configuration of a control system of the roulette gaming machine 1 according to the embodiment will be discussed based on FIG. 13. FIG. 13 is a block diagram to schematically show the control system of the roulette gaming machine.

As shown in FIG. 13, the roulette gaming machine 1 includes a main control section 83 including the above-mentioned main control CPU 80, the above-mentioned ROM 81, and RAM 82 and the roulette board 2, the 10 satellites 4 (see FIG. 1), the above-mentioned on-off valve 18, and the ball discharging unit 43 connected to the main control section 83. The control system of the satellite 4 is described later in detail.

The main control CPU 80 performs various types of processing based on input signals, etc., supplied from the satellites 4 and data and programs stored in the ROM 81 and the RAM 82, and transmits instruction signals to the satellites 4 based on the processing result, thereby controlling the satellites 4 under the initiative of the main control CPU 80 for advancing games. Further, the main control CPU 80 drives the drive motor 34 and controls the ball detection sensors 44 (see FIG. 10) provided in the roulette board 2 for determining the win number corresponding to the ball reception portion 23 into which the ball 11 drops. The main control CPU 80 makes a win or loss determination of bet chips based on the obtained win number and bet information transmitted from each satellite 4 and calculates the credit count to be paid out to the player at the satellite 4.

The ROM 81 is implemented as semiconductor memory, for example, and stores a program for providing the basic function of the roulette gaming machine 1, a program for controlling the units in the roulette board 2 and the on-off valve 18, a program for controlling the drive motor 34, a program for controlling the solenoid 102, the odds for a usual roulette game using the BET screen 61 (the credit payout number of chips responsive to a win per chip), a program for controlling the satellites 4 under the initiative of the main control CPU 80, and the like.

The RAM 82 temporarily stores chip bet information supplied from the satellites 4, the win number of the roulette board 2 determined by the ball detection sensor 44, data concerning the result of the processing executed by the main control CPU 80, and the like.

The on-off valve 18 for adjusting the air pressure in the air tube 16 is connected to the main control CPU 80. The on-off valve 18 is opened, whereby air compressed by the compressor 14 is ejected from the rotation ejection nozzles 36 made in the banked passage 29.

The ball detection sensors 44, the origin sensor 57, and the rotation sensor 58 provided in the roulette board 2 are also connected to the main control CPU 80. The three ball detection sensors 44 are provided in the fixed center section 22 as described above and if the ball 11 is received in the ball reception portion 23 positioned at the front of the ball detection sensor 44, the presence of the ball reception portion 23 and the number corresponding thereto can be detected. The origin sensor 57 can detect the relative position of the ball reception portion 23 positioned at the front of the origin sensor 57 to the origin (the ball reception portion associated with "00"). The rotation sensor 58 can detect whether or not the rotating circumferential section 20 rotates. The detection results of the sensors are transmitted to the main control CPU 80, which then determines the win number.

The drive motor 34 for rotating the rotating circumferential section 20 through the motor drive circuit 55 is also connected to the main control CPU 80. When a motor drive signal is output from the main control CPU 80 to the motor drive circuit 55, the drive motor 34 is given a pulse signal from the motor drive circuit 55 and is rotated as many as a predetermined number of revolutions in a predetermined rotation direction based on the pulse signal. Accordingly, the rotating circumferential section 20 is rotated at a predetermined angle (for example, 45 degrees) in a predetermined rotation direction (for example, clockwise) relative to the fixed center section 22 and the frame 21, and it is made possible to place any desired ball reception portion 23 at the front position of the ball discharging unit 43.

Further, the solenoid 102 of the ball discharging unit 43 is connected to the main control CPU 80 through the solenoid drive circuit 85. When a solenoid drive signal is output from the main control CPU 80 to the solenoid drive circuit 85, the solenoid drive circuit 85 supplies given power to the solenoid 102 and the distal portion 103 of the rod 101 moves to the advance position (moving from the position shown in FIG. 8A to the position shown in FIG. 8B). Consequently, the rod 101 passes through the rod passage hole 35 made in the inner wall 37 and collides with (comes in contact with) the ball 11 received in the ball reception portion 23 and the ball 11 can be discharged toward the direction of the banked passage 29 by the collision force.

Further, a timer 84 for performing time measurement is connected to the main control CPU 80. Time information of the timer 84 is transmitted to the main control CPU 80, which then opens/closes the on-off valve 18 and supplies power to the solenoid 102 as described later based on the time information of the timer 84.

Figure 15:
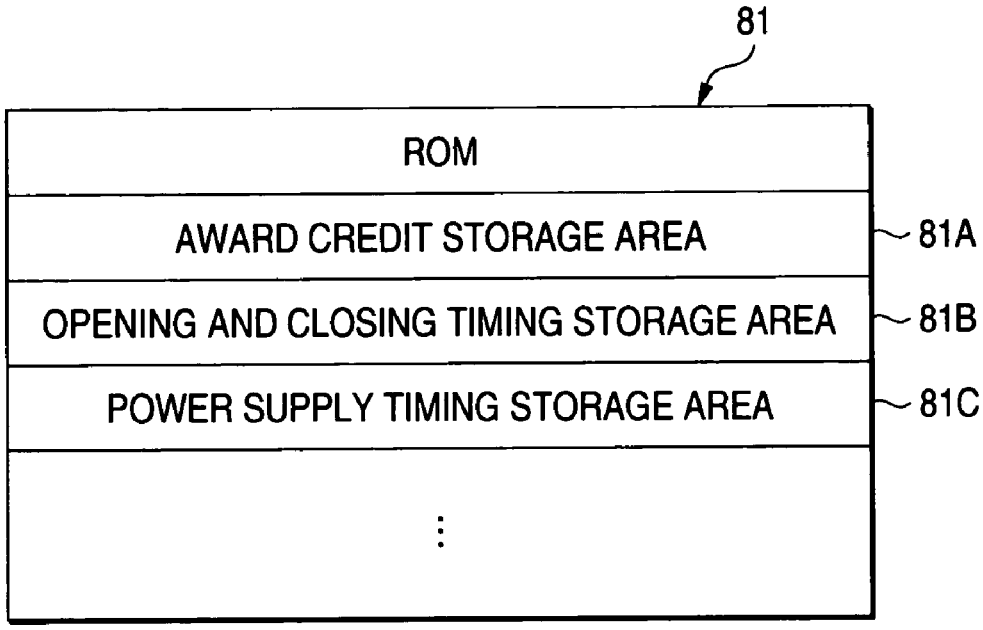
FIG. 15 is a schematic drawing to show storage areas of ROM of the roulette gaming machine according to the embodiment.

As shown in FIG. 15, the ROM 81 is provided with an award credit storage area 81A storing the odds concerning a roulette game using the BET screen 61, an opening and closing timing storage area 81B storing the opening and closing timings of the on-off valve 18, and a power supply timing storage area 81C storing the power supply timing to the solenoid 102. As the odds for each BET area of the BET screen 61 stored in the award credit storage area 81A, an award of "X2" to "X36" is given depending on the bet method (straight up, corner bet, split bet, etc.)

Figure 17:
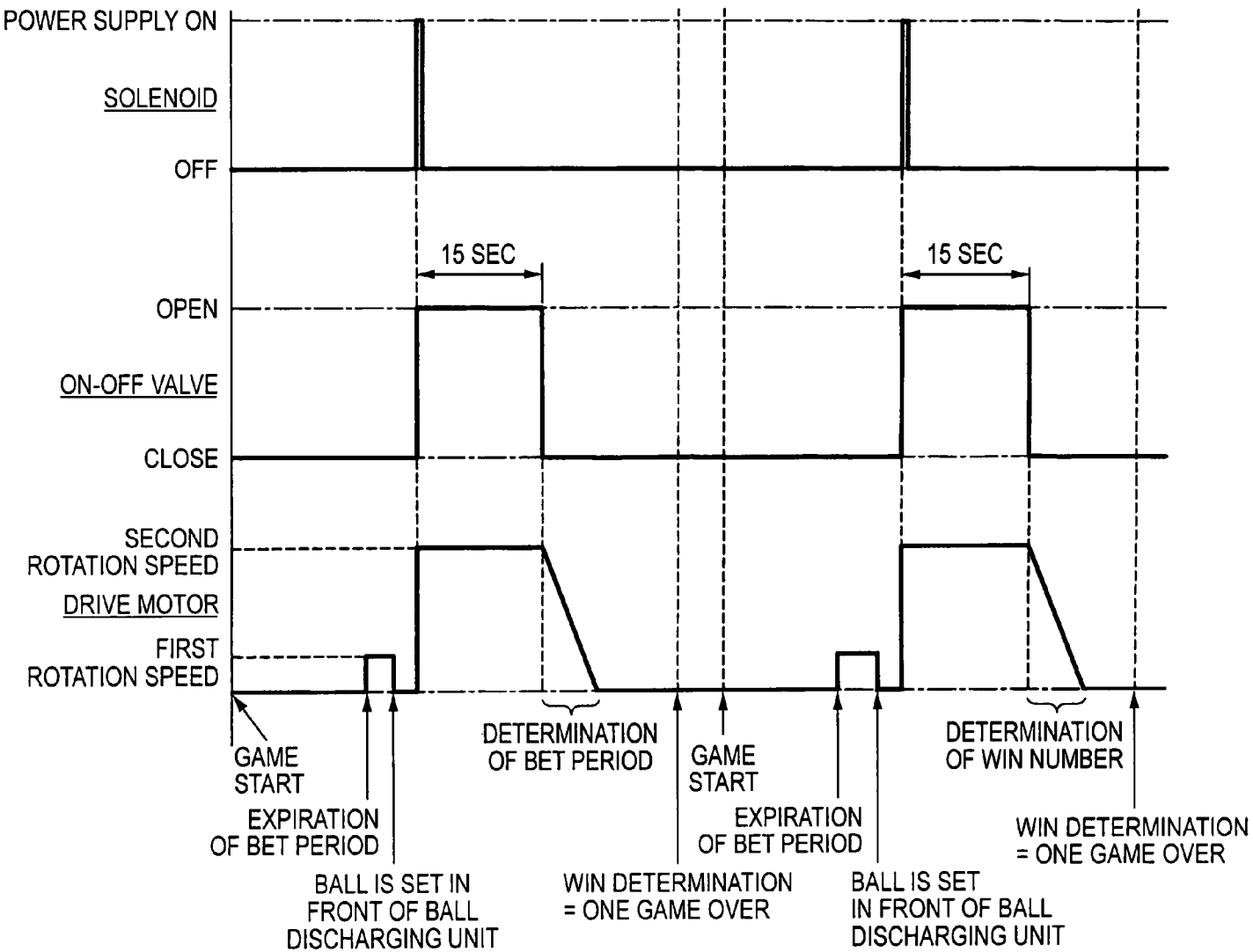
FIG. 17 is a schematic representation to show the opening and closing timings of an on-off valve and the drive control of the solenoid and a drive motor.

Next, the opening and closing timings of the on-off valve 18 stored in the ROM 81 and the drive control of the solenoid 102 and the drive motor 34 are shown based on FIG. 17. FIG. 17 is a schematic representation to show the opening and closing timings of the on-off valve 18 and the drive control of the solenoid 102 and the drive motor 34.

As shown in FIG. 17, when a game is started, first the bet period during which the player bets a chip at each satellite 4 is started. When the bet period expires (the BET timer graph 69 of the BET screen 61 reaches the rightmost side), the position of the ball reception portion 23 in which the ball 11 is received is determined based on the preceding win number and the detection result of the origin sensor 57, the drive motor 34 is driven at predetermined first rotation speed until the ball reception portion 23 is positioned at the front of the ball discharging unit 43 (position where the rod 101 and the ball 11 in the ball reception portion come in contact with each other), and the rotating circumferential section 20 is rotated at predetermined rotation speed (for example, $0.2\pi$ [rad/s]) relative to the fixed center section 22. Then, the main control CPU 80 supplies given power to the solenoid 102 from the solenoid drive circuit 85 for driving the solenoid 102. Further, at the same time as the solenoid 102 is driven, the on-off valve 18 is opened for producing an annular air layer flowing along the banked passage 29 of the roulette wheel 12 (see FIG. 21). The ball 11 is discharged as it collides with the rod 101 moved ahead of the ball discharging unit 43. The ball 11 rolled toward the direction of the banked passage 29 rotates clockwise in the banked passage 29 in accordance with the air flow. At the same time, the drive motor 34 is driven at predetermined second rotation speed and the rotating circumferential section 20 is rotated at predetermined rotation speed (for example, $2\pi$ [rad/s]) relative to the fixed center section 22.

Then, after the expiration of a predetermined time (in the embodiment, 15 seconds), the main control CPU 80 closes the on-off valve 18. Accordingly, the air ejected from the rotation ejection nozzles 36 stops and the rotation speed of the ball 11 gradually grows weak. The circle drawn by the ball 11 becomes gradually small and last the ball 11 loses the centrifugal force, rolls down on the slope 28, and is housed in one of the ball reception portions 23. After the on-off valve 18 is closed, the rotation speed of the drive motor 34 is gradually attenuated for slowing down the rotation speed of the rotating circumferential section 20. Meanwhile, the win number is determined according to the sensors of the ball detection sensors 44, the origin sensor 57, and the rotation sensor 58. Further, medals are paid out in accordance with the determined win number. The one game is now over. Further, to start another game successively, another bet period at the satellite 4 is started and when the bet period expires, the main control CPU 80 drives the solenoid 102. The roulette game processing program based on the opening and closing timings of the on-off valve 18 and the drive control of the solenoid 102 and the drive motor 34 is described later in detail with a flowchart of FIG. 18.

Figure 16:
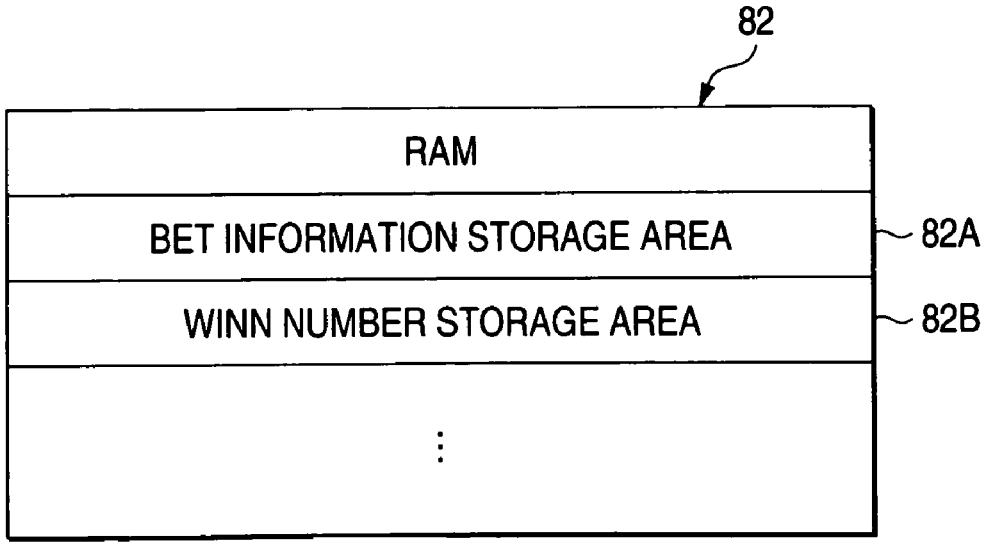
FIG. 16 is a schematic drawing to show storage areas of RAM of the roulette gaming machine according to the embodiment.

The RAM 82 is provided with a bet information storage area 82A for storing the bet information of the player playing a game at present and a win number storage area 82B for storing the win number of the roulette wheel 12 determined according to the ball detection sensors 44, as shown in FIG. 16. The bet information specifically is the BET areas and the number of bet chips specified on the BET screen 61.

Figure 14:
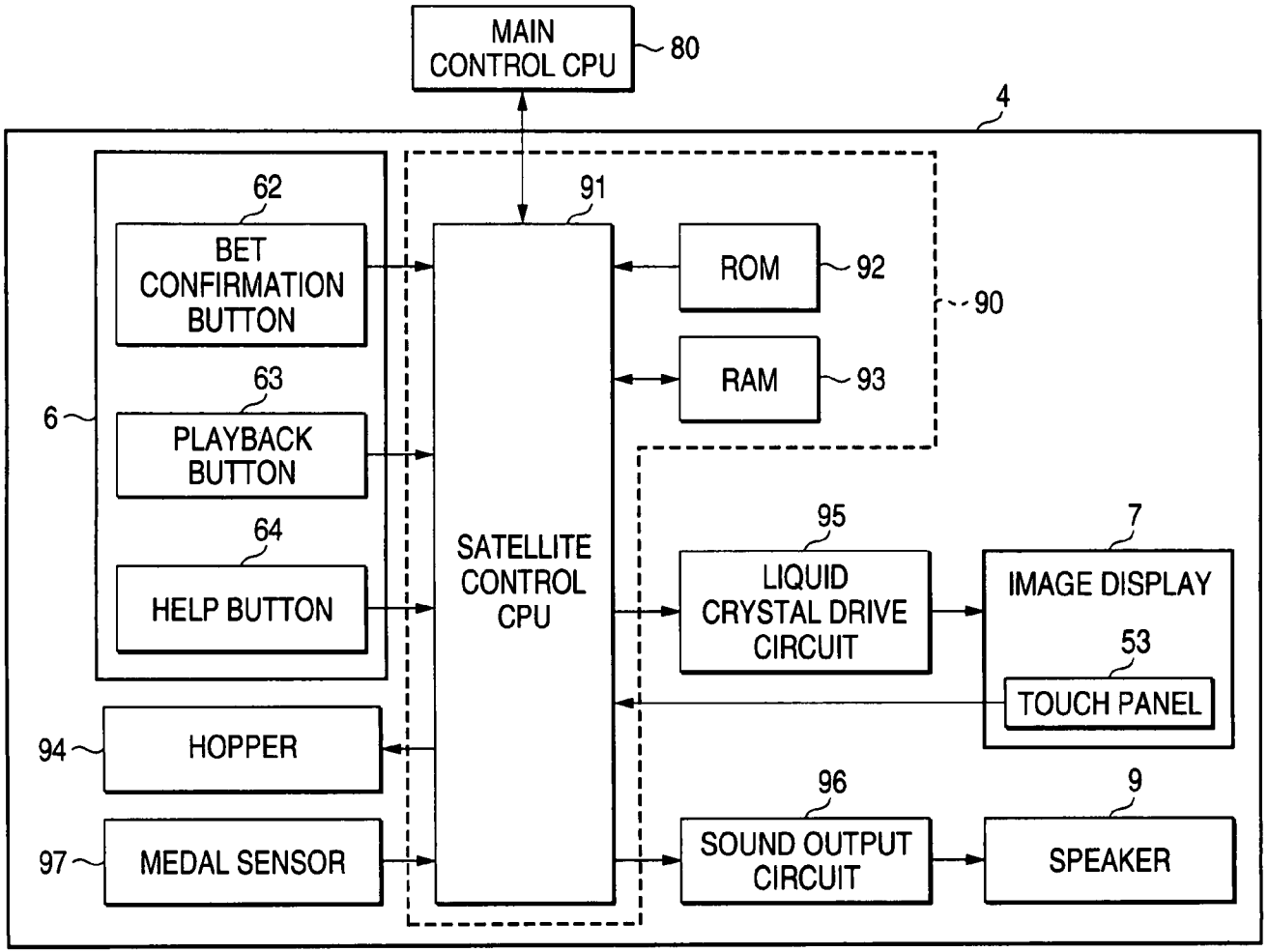
FIG. 14 is a block diagram to schematically show a control system of a satellite according to the embodiment.

Next, the configuration of the control system of the satellite 4 connected to the main control CPU 80 of the main control section 83 according to the embodiment will be discussed with reference to FIG. 14. FIG. 14 is a block diagram to schematically show the control system of the satellite 4 according to the embodiment. The 10 satellites 4 basically have the same configuration and therefore in the description to follow, one satellite 4 is taken as an example.

The satellite 4 is provided with a satellite control section 90 and several peripheral devices, as shown in FIG. 14. The satellite control section 90 includes a satellite control CPU 91, ROM 92, and RAM 93. The ROM 92 is implemented as semiconductor memory, etc., for example, and stores a program for providing the basic function of the satellite 4, various programs required for controlling the satellite 4, a data table, and the like. The RAM 93 is memory for temporarily storing various pieces of data on which operations are performed by the satellite control CPU 91, the current credit count owned by the player, the chip bet state of the player, and the like.

The BET confirmation button 62, the payback button 63, and the help button 64 placed on the control section 6 (see FIG. 1) are connected to the satellite control CPU 91. Based on an operation signal output as each button is pressed, etc., the satellite control CPU 91 controls the satellite to execute the corresponding operation. Specifically, the satellite control CPU 91 executes various types of processing based on an input signal supplied from the control section 6 in response to entry of operation of the player and the data and the programs stored in the ROM 92 and the RAM 93, and transmits the processing result to the main control CPU 80 of the main control section 83 described above.

The satellite control CPU 91 receives an instruction signal from the main control CPU 80 and controls the peripheral machines making up the satellite 4 for advancing the roulette game in the satellite 4. Depending on the processing, the satellite control CPU 91 executes various types of processing based on an input signal supplied from the control section 6 in response to entry of operation of the player and the data and the programs stored in the ROM 92 and the RAM 93, and controls the peripheral machines making up the satellite 4 for advancing the roulette game in the satellite 4. Which method the processing is to be performed according to is determined for each processing in response to the processing type. For example, medal payout processing responsive to the win number corresponds to the former type of processing and bet operation processing of the player on the BET screen 61 corresponds to the latter type of processing.

A hopper 94 is also connected to the satellite control CPU 91. The hopper 94 pays out a predetermined number of medals to the player from the medal payout opening 8 (see FIG. 1) in response to an instruction signal from the satellite control CPU 91.

Further, the image display 7 is connected via a liquid crystal drive circuit 95 to the satellite control CPU 91. The liquid crystal drive circuit 95 includes program ROM, image ROM, an image control CPU, work RAM, a VDP (video display processor), video RAM, etc. The program ROM stores an image control program and various selection tables concerning display on the image display 7. The image ROM stores data (bitmap data) to form images displayed on the image display 7. The image control CPU determines the image to be displayed on the image display 7 from the bitmap data previously stored in the image ROM in accordance with the image control program previously stored in the program ROM based on a parameter set in the satellite control CPU 91. The work RAM is implemented as temporary storage means for the image control CPU to execute the image control program. The VDP forms an image responsive to the display determined by the image control CPU and outputs the image to the image display 7. The video RAM is implemented as temporary storage means for the VDP to form an image.

The touch panel 53 is attached to the front of the image display 7 as mentioned above, and operation information of the touch panel 53 is transmitted to the satellite control CPU 91. Through the touch panel 53, the player bets chips on the BET screen 61. Specifically, the player operates the touch panel 53 in selecting the BET area, operating the unit BET button 66, and the like, and touch panel operation information is transmitted to the satellite control CPU 91. Based on the information, the current bet information of the player (the BET areas specified on the BET screen 61 and the number of bet chips) is stored in the RAM 93 whenever necessary. Further, the bet information is transmitted to the main control CPU 80 and is stored in the bet information storage area 82A of the RAM 82.

Further, a sound output circuit 96 and the above-mentioned speaker 9 are connected to the satellite control CPU 91. The speaker 9 produces various effect sounds in making various effects based on output signals from the sound output circuit 96.

A medal sensor 97 is also connected to the satellite control CPU 91. The medal sensor 97 detects medals input through the medal insertion slot 5 (FIG. 1), calculates the number of the input medals, and transmits the result to the satellite control CPU 91. The satellite control CPU 91 increments the credit count of the player stored in the RAM 93 based on the transmitted signal.

Subsequently, the game processing program in the roulette gaming machine 1 according to the embodiment will be discussed based on FIG. 18. FIG. 18 is a flowchart of the roulette game processing program in the roulette gaming machine 1 according to the embodiment. The program shown in the flowchart of FIG. 18 is stored in the ROM 81 and the RAM 82 included in the roulette-gaming machine 1 and is executed by the main control CPU 80.

First, at step 1 (S1), the main control CPU 80 determines whether or not the player inputs a medal or a coin. In the roulette gaming machine 1 according to the embodiment, if a medal or a coin is input to the medal insertion slot 5 at any satellite 4, the medal sensor 97 detects the medal or coin input and transmits the fact to the satellite control CPU 91. Then, further, medal input signal is sent from the satellite 4 to the main control section 83. Accordingly, the main control CPU 80 determines medal or coin input of the player. If a medal or a coin is not input (NO at S1), a wait mode is entered until a medal or a coin is input; if a medal or a coin is input (YES at S1), the process goes to S2. If a medal or a coin is input, the credit data of the amount responsive to the number of input medals or coins is recorded in the RAM 93 of the satellite control section 90.

The BET screen 61 shown in FIG. 12 is displayed on the image display 7 of the satellite 4 used by the player, enabling the player to bet a chip. Any other player can participate in the game in the course thereof and the roulette gaming machine 1 according to the embodiment allows a maximum of 10 players to play a game.

When the first player participating in the game inputs a medal or a coin, the bet period of the acceptance period during which the player can bet a chip is started (S2). If the current game is played successively following the preceding game, another bet period is started successively after the preceding game is over. Each player participating in the game can operate the touch panel 53 to bet his or her chip on the BET area relevant to his or her predicted number during the bet period (see FIG. 12). The specific bet method using the BET screen 61 is previously described and therefore will not be discussed again.

Next, at S3, whether or not the bet period expires is determined. The bet period is indicated by the BET timer graph 69, and the red graph starts to extend to the right gradually from the bet period start time (S2). When the BET timer graph 69 extends to the rightmost side, the current bet period expires.

Before the bet period expires (NO at S3), a bet is accepted successively. On the other hand, if the bet period expires (YES at S3), a bet end signal is output to the satellite control sections 90 of all satellites 4 and an image indicating the bet end is displayed on the liquid crystal screen of each satellite 4, prohibiting bet operation through the touch panel 53. The bet information of the player at each satellite 4 (the specified BET area and the number of chips bet on the specified BET area) is received (S4) and is stored in the bet information storage area 82A of the RAM 82.

Next, the main control CPU 80 executes lottery processing with the roulette board 2 in accordance with a game execution program. Specifically, first the main control CPU 80 reads the win number in the preceding game (1 to 36, 0, 00) from the win number storage area 82B of the RAM 82 (S5). The main control CPU 80 drives the drive motor 34 at the predetermined first rotation speed and rotates the rotating circumferential section 20 at predetermined rotation speed (for example, 0.2π [rad/s]) relative to the fixed center section 22 (S6).

At the time, the rotation sensor 58 detects rotation of the rotating circumferential section 20 and the origin sensor 57 provided in the fixed center section 22 determines the preceding win number acquired at S5, namely, the ball reception portion 23 in which the ball 11 is received at the current point in time is at what position relative to the ball discharging unit 43. At S7, whether or not the ball reception portion 23 in which the ball 11 is received is positioned at the front of the ball discharging unit 43 with rotation of the rotating circumferential section 20 is determined based on the determined position.

When determined that the ball reception portion 23 in which the ball 11 is received is positioned at the front of the ball discharging unit 43 (YES at S7), driving the drive motor 34 is stopped (S8). On the other hand, when not determined that the ball reception portion 23 in which the ball 11 is received is positioned at the front of the ball discharging unit 43 (NO at S7), the drive motor 34 is driven successively.

Figure 19:
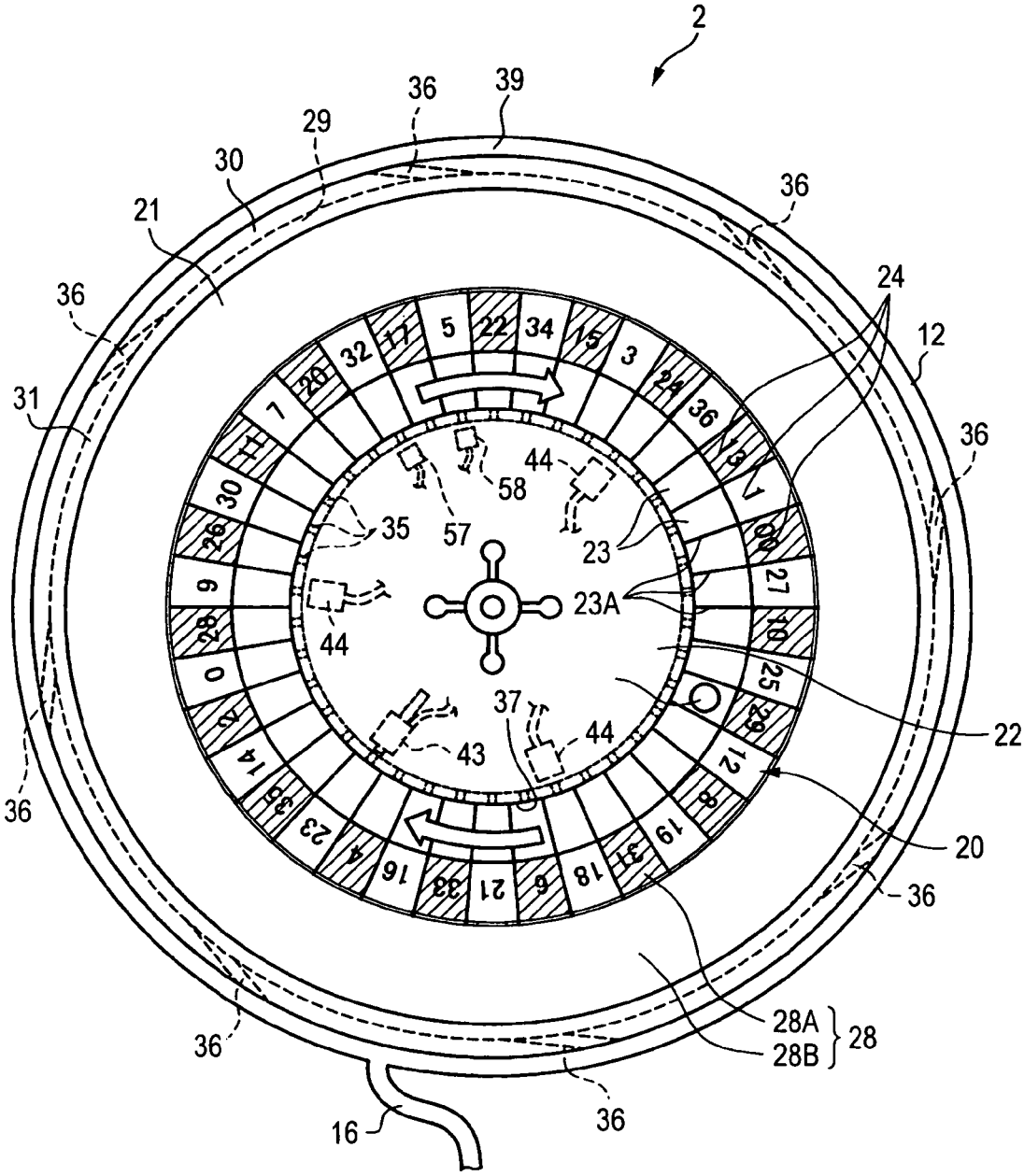
FIG. 19 is a schematic drawing to show a ball rolling mode of the roulette board at step 6.

FIG. 19 is a schematic drawing to show a rotation mode of the rotating circumferential section 20 of the roulette board 2 at steps 6 to 8. As shown in FIG. 19, if the ball reception portion 23 in which the ball 11 is received (in FIG. 19, the ball reception portion associated with the number 29) is the ball reception portion 23 at the eleventh position in the left direction relative to the ball discharging unit 43, the rotating circumferential section 20 is rotated clockwise. As the rotating circumferential section 20 is rotated at a predetermined angle (in FIG. 19, the angle corresponding to 11 ball reception portions 23 in the right direction), when the ball reception portion 23 in which the ball 11 is received is positioned at the front of the ball discharging unit 43, the rotation of the rotating circumferential section 20 is stopped.

Figure 20:
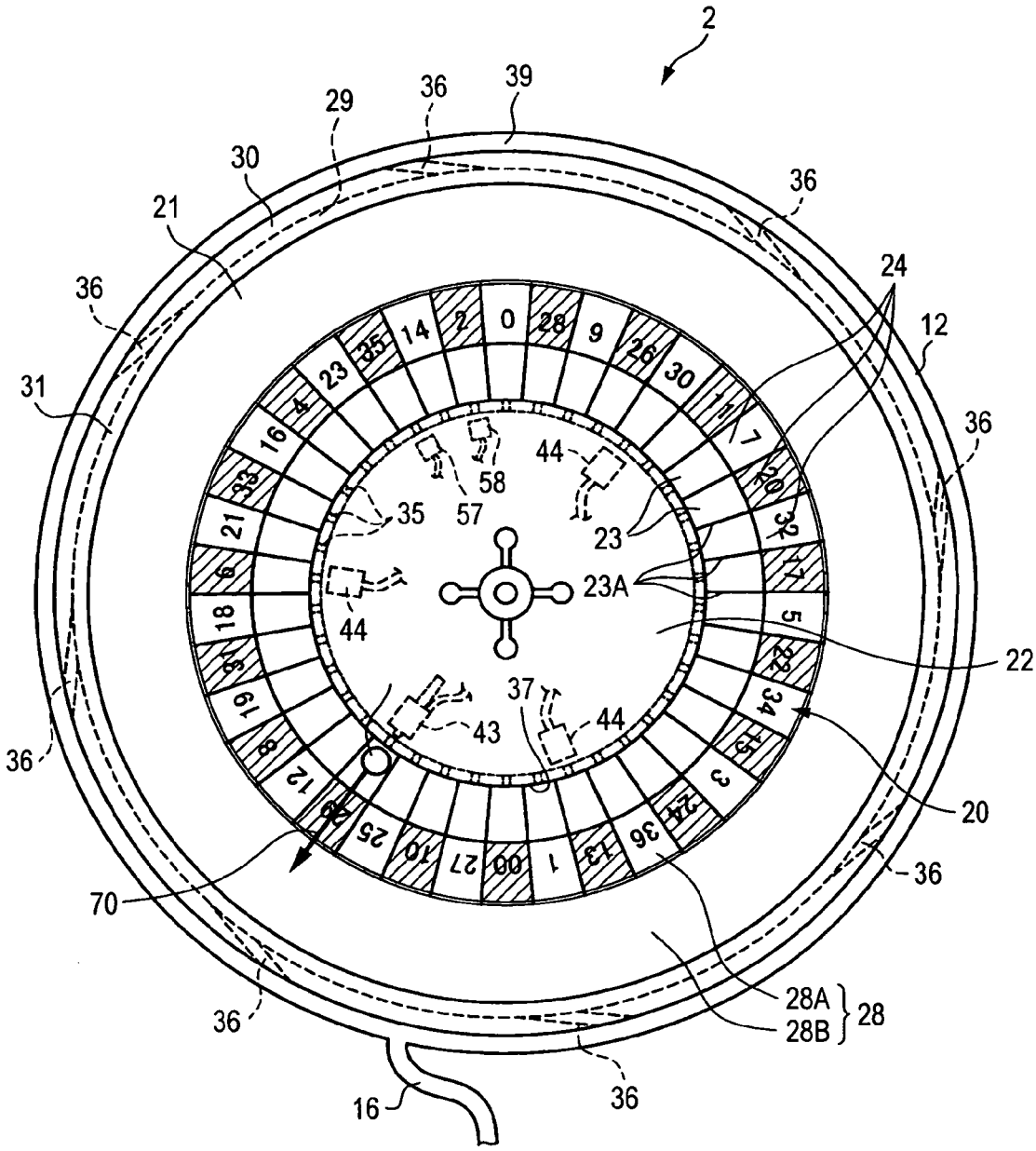
FIG. 20 is a schematic drawing to show a ball rolling mode of the roulette board at step 10.

Next, at S9, power of the compressor 14 is turned on for starting to compress air by the compressor 14. Further, at S10, given power is supplied from the solenoid drive circuit 85 to the solenoid 102 for driving the solenoid 102. When the given power is supplied to the solenoid 102, a magnetic field is generated in the coil 109 of the solenoid 102 (see FIG. 7). The magnetic field causes the plunger 108 to be attracted to the coil 109 for moving the distal portion 103 of the rod 101 to an advance position (moving from the position shown in FIG. 8A to the position shown in FIG. 8B). Consequently, the rod 101 passes through the rod passage hole 35 made in the inner wall 37 and collides with (comes in contact with) the ball 11 received in the ball reception portion 23 and the ball 11 is rolled to the banked passage 29 against the inclination of the slope 28 by the collision force. FIG. 20 is a schematic drawing to show a rolling mode of the ball 11 of the roulette board 2 at step 10.

As shown in FIG. 20, when the solenoid 102 is driven at S10, the rod 101 passes through the rod passage hole 35 made in the inner wall 37 and collides with (comes in contact with) the ball 11 received in the ball reception portion 23 and the ball 11 is rolled toward the direction of the banked passage 29 (the direction of an arrow 70) by the collision force.

The main control CPU 80 stops the power supply from the solenoid drive circuit 85 just after the ball 11 is discharged. When the power supply to the solenoid 102 is stopped, the plunger 108 of the rod 101 is released and the spring 110 presses the plunger 108 of the rod 101, thereby moving the rod 101 to the retract position (moving from the position shown in FIG. 8B to the position shown in FIG. 8A). The rod 101 is made to stand by at the position until the next discharging time of the ball 11.

Figure 21:
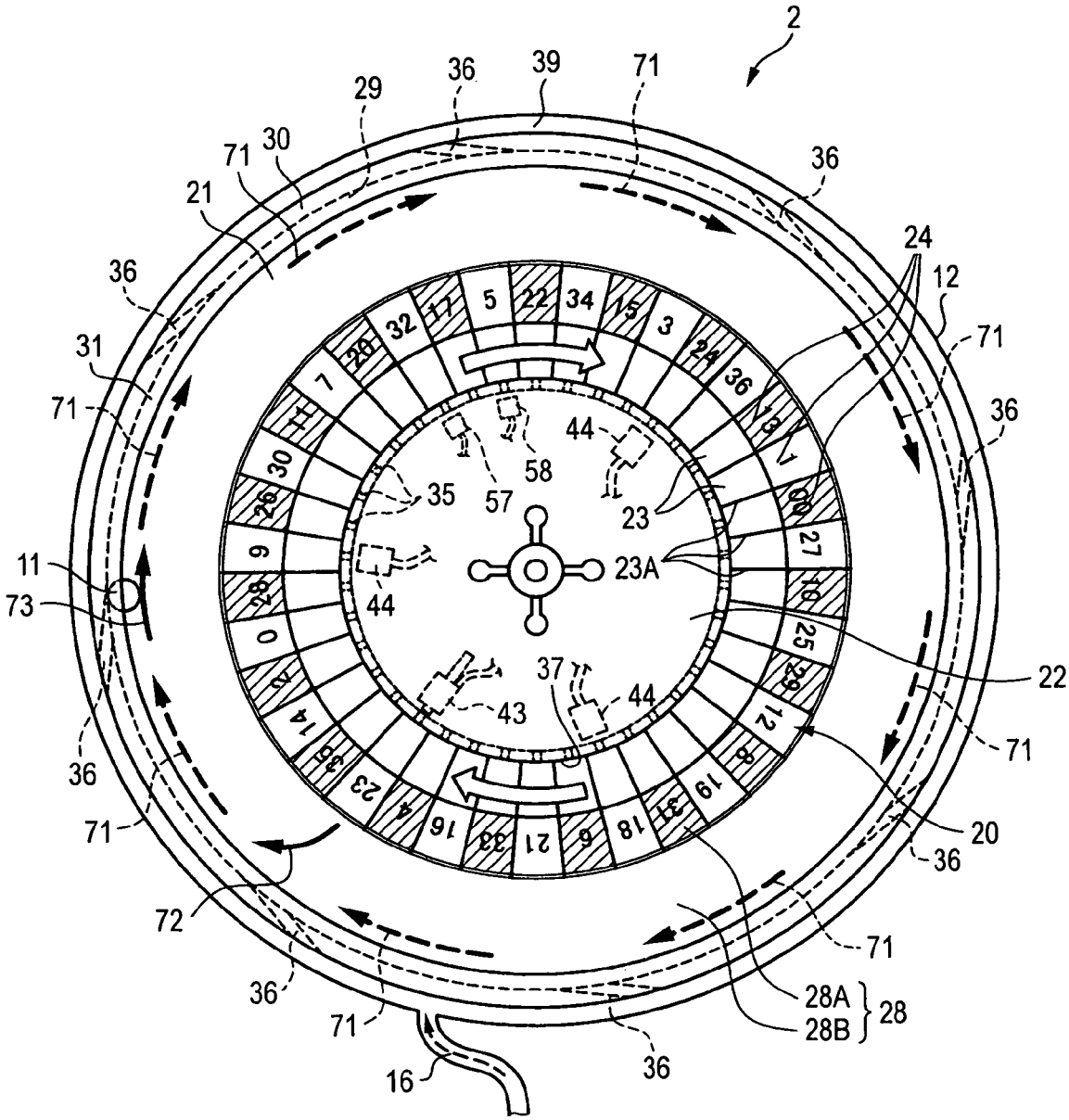
FIG. 21 is a schematic drawing to show a ball rolling mode of the roulette board at step 11.

Next, at S11, the on-off valve 18 is opened. The on-off valve 18 is provided in the air tube 16 for transporting the air compressed by the compressor 14 to the rotation ejection nozzles 36, and makes it possible to adjust the air pressure of the air passing through the air tube 16, as described above. When the on-off valve 18 is opened, ejection of compressed air from the rotation ejection nozzles 36 is started. Accordingly, an air layer flowing clockwise along the banked passage 29 is produced and the ball 11 rolled to the banked passage 29 at S10 starts to roll drawing a circular orbit in accordance with the ejected air pressure. FIG. 21 is a schematic drawing to show a rolling mode of the ball 11 of the roulette board 2 at step 11.

As shown in FIG. 21, when the on-off valve 18 is opened at S11, a clockwise air flow (in the direction of an arrow 71) along the banked passage 29 is formed in the roulette wheel 12 according to air ejected from the rotation ejection nozzles 36 provided in the banked passage 29. The ball 11 rolled toward the direction of the banked passage 29 by the ball discharging unit 43 is changed in the rolling direction to the circumferential direction of the roulette wheel 12 in accordance with the air pressure from the rotation ejection nozzles 36 (see an arrow 72). Further, the ball 11 to which the air pressure from the rotation ejection nozzles 36 is added is rolled gradually to the outer circumference of the roulette wheel 12 by a centrifugal force and starts to roll along the banked passage 29 (see an arrow 73). The banked passage 29 guides the ball 11 rolling on the roulette wheel 12 against the centrifugal force for rolling the ball 11 drawing a circumferential orbit. Further, the wall part 31 continuous with the banked passage 29 is formed at the upper end of the outer peripheral portion, so that it is not feared that the ball 11 making rotational motion on the banked passage 29 will rush out into the outside of the roulette wheel 12.

Next, at S12, the drive motor 34 is driven at the predetermined second rotation speed and the rotating circumferential section 20 is rotated at predetermined rotation speed (for example, 2π [rad/s]) relative to the fixed center section 22 (see FIG. 20). At the same time, the rotation sensor 58 detects rotation of the rotating circumferential section 20 and the origin sensor 57 provided in the fixed center section 22 always detects the ball reception portion 23 positioned at the front of the origin sensor 57 is at what position relative to the origin (the ball reception portion corresponding to "00")

At S13, whether or not a predetermined time (in the embodiment, 15 seconds) has elapsed since the on-off valve 18 was opened is determined. The passage of time is measured by the timer 84 connected to the main control CPU 80. If a measurement value t2 since the on-off valve 18 was opened is less than 15 seconds (NO at S13), the on-off valve 18 is continuously opened.

On the other hand, if the measurement value t2 since the on-off valve 18 was opened is equal to or greater than 15 seconds (YES at S13), the process goes to S14.

At S14, the main control CPU 80 closes the on-off valve 18 and stops ejecting of air from the rotation ejection nozzles 36. Further, at S15, the main control CPU 80 turns off the power of the compressor 14 and stops air compressing of the compressor 14.

Figure 22:
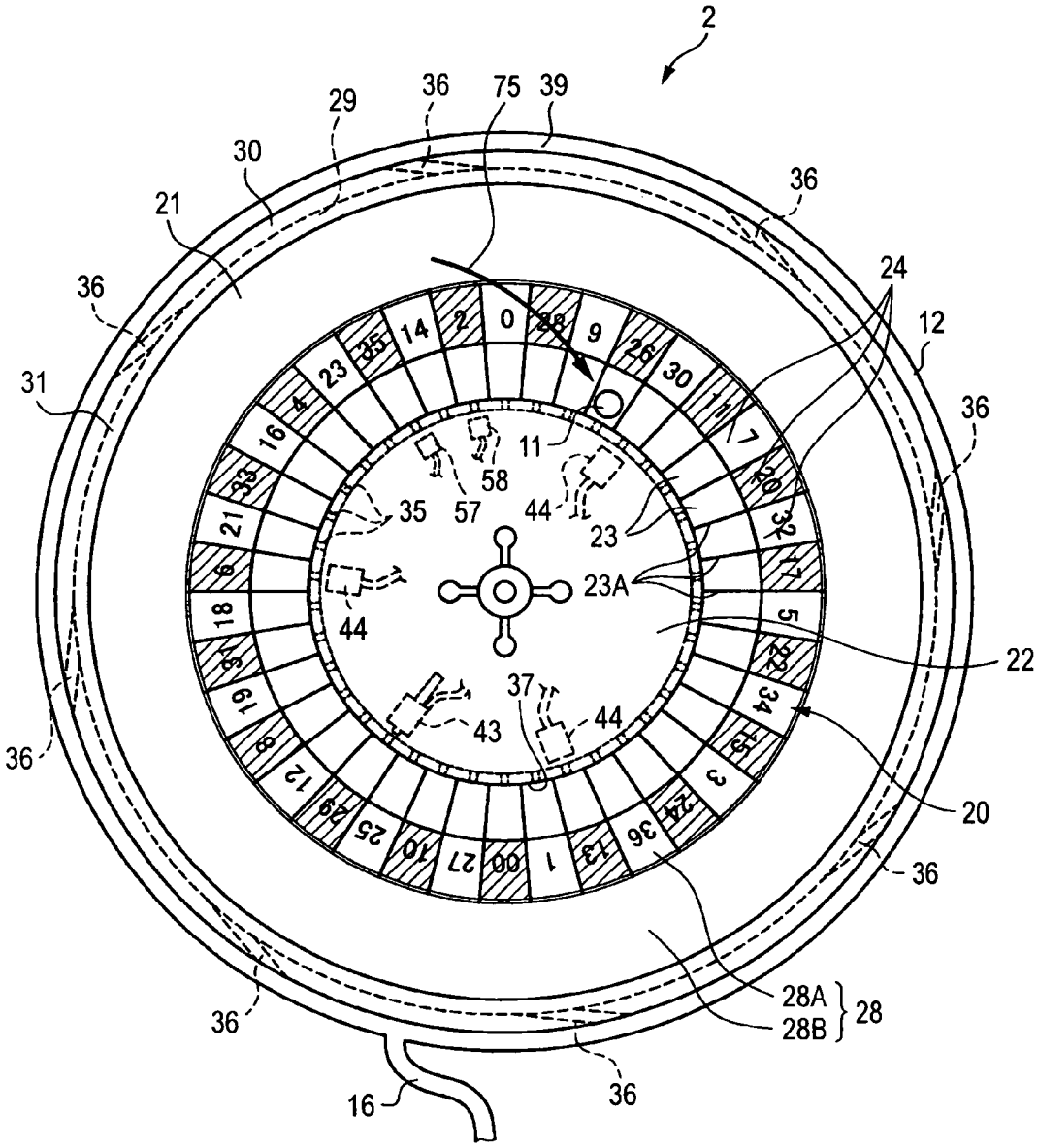
FIG. 22 is a schematic drawing to show a ball rolling mode of the roulette board at step 14.
Figure 23:
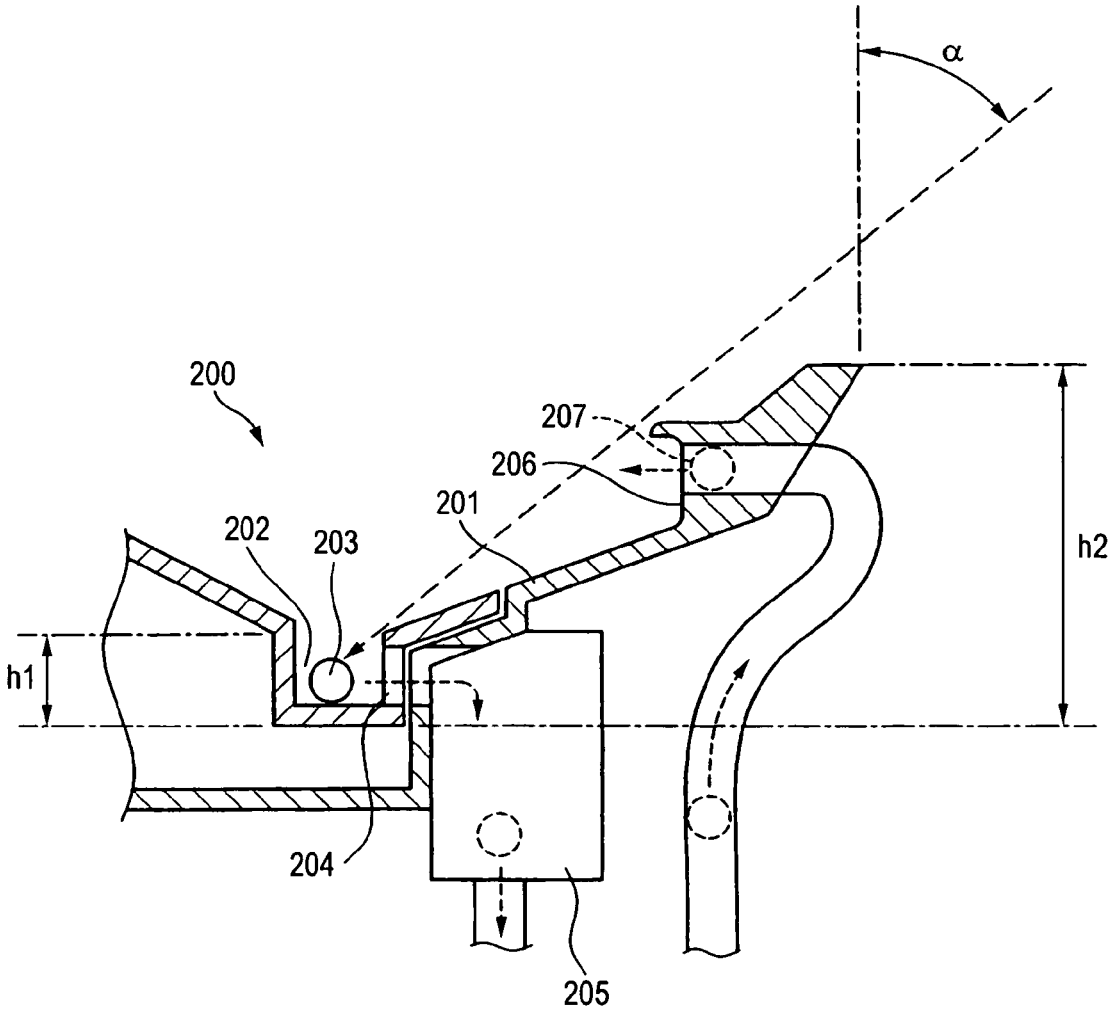
FIG. 23 is a schematic drawing to show a roulette board used with a roulette gaming machine according to a related art.
Figure 24:
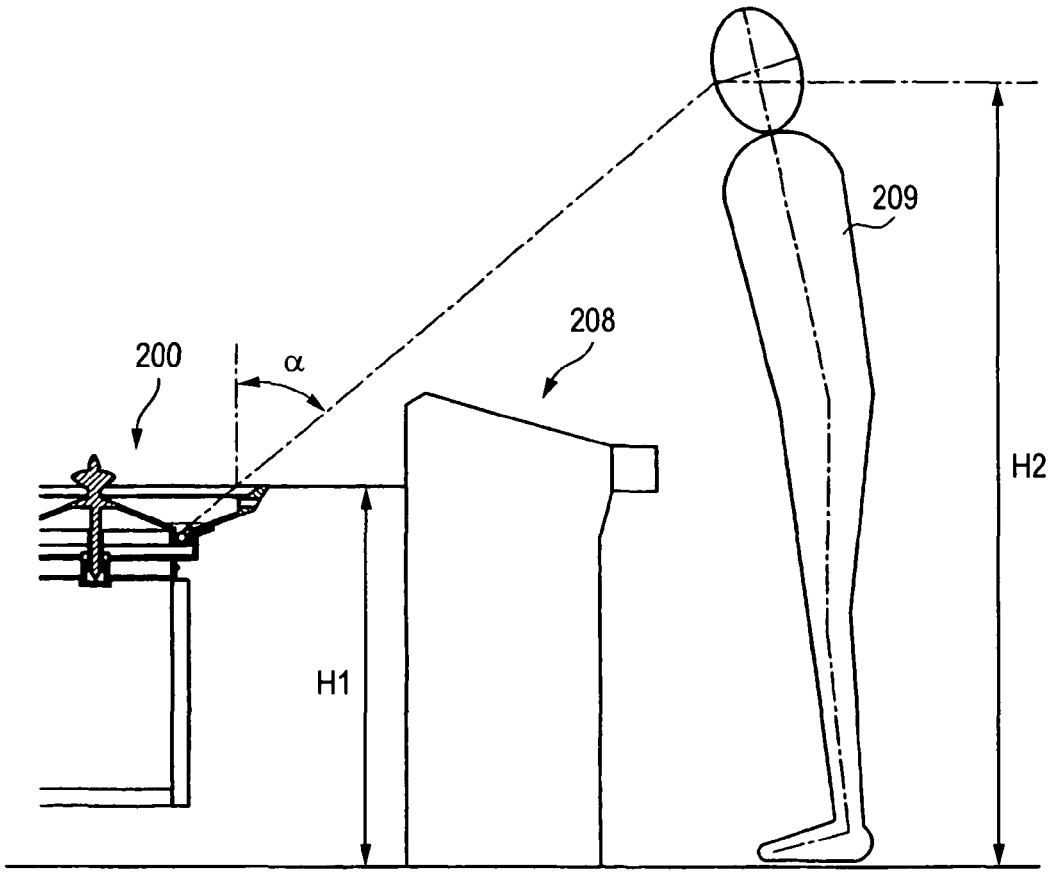
FIG. 24 is a schematic drawing to show the roulette board used with the roulette gaming machine according to the related art.

The air ejection from the rotation ejection nozzles 36 is stopped, whereby the ball 11 rolling along the banked passage 29 loses the air pressure from the rotation ejection nozzles 36, the rotation speed gradually slows down, and the centrifugal force lowers. Finally, the ball 11 rolls down on the slope 28, goes to the inside of the roulette wheel 12, and reaches the rotating rotating circumferential section 20. FIG. 22 is a schematic drawing to show a rolling mode of the ball 11 of the roulette board 2 at step 14.

As shown in FIG. 22, when the on-off valve 18 is closed at S14, the air ejected from the rotation ejection nozzles 36 provided in the banked passage 29 stops and the rotation speed of the ball 11 losing the air pressure gradually lowers. The ball 11 whose centrifugal force as well as rotation speed lowers continues to draw a circumferential orbit while moving gradually toward the inside direction from the banked passage 29 along the inclination of the slope 28. Finally, the ball 11 rolls down on the slope 28, goes to the inside of the roulette wheel 12, and reaches the rotating rotating circumferential section 20 (see an arrow 75).

The ball 11 rolling toward the direction of the rotating circumferential section 20 further passes through the tops of the number indication plates 24 on the outside of the rotating rotating circumferential section 20 and is received in any one of the ball reception portions 23 and the number described on the number indication plate 24 corresponding to the ball reception portion 23 in which the ball 11 is received (any of 0, 00, 1 to 36) becomes the win number.

Subsequently, at S16, the rotation speed of the drive motor 34 is gradually attenuated and the ball detection sensor 44 detects the ball 11 received in the ball reception portion 23. The number associated with the ball reception portion 23 with the ball 11 detected (any of 0, 00, 1 to 36), namely, the win number is determined from the detection result of the origin sensor 57 at the ball detection timing of the ball detection sensor 44.

Further, the main control CPU 80 stops driving the drive motor 34 (S17) and determines whether or not the bet chip is a win at each satellite 4 from the bet information at each satellite 4 received at S4 and the win number determined at S16 (S18).

Whether or not the bet chip is a win at least at one satellite 4 is determined based on the win determination at S18 (S19). If it is determined that the bet chip is a win (YES at S19), the main control CPU 80 executes award calculation processing (S20). In the award calculation processing, the win chip is recognized for each satellite 4 and the total of the award amounts of the credit paid out to the player at each satellite 4 is calculated using the odds for the BET area stored in the award credit storage area 81A of the ROM 81 (credit points paid out per chip). Subsequently, the process goes to S21.

On the other hand, if a win chip exists at none of the satellites 4 (NO at S19), the process goes to S22.

At S21, credit payout processing is executed based on the award calculation processing at S20. To pay out the credit to the player at the satellite 4, credit data equivalent to the award amount is output from the main control section 83 to the satellite control sections 90 of the winning satellite 4. The credit data is added to the RAM 93 of the corresponding satellite 4.

At S22, whether or not the player at least at one satellite 4 continues to play a game is determined. To quit the game play, usually the player presses the payback button 63. If the player presses the payback button 63, medals responsive to the credit acquired by playing games, etc., and owned by the player at present (usually, one medal per credit point) are paid back from the medal payout opening 8 through the hopper 94.

If the player at any of the satellites 4 continues to play a game (NO at S22), the process returns to S2 and again another bet period is started for starting another game.

On the other hand, if the players at all of the satellites 4 quit the game play (YES at S22), the roulette game processing is terminated.

As described above, the roulette gaming machine 1 according to the embodiment is provided with the ball discharging unit 43 for discharging the ball 11 to the fixed center section 22 fixedly supported in the center of the roulette wheel 12 in the roulette board 2 by driving the solenoid 102 and the various sensors such as the ball detection sensors 44 for determining the win number. The rotating rotating circumferential section 20 is rotated so that the ball reception portion 23 in which the ball 11 is positioned at the front of the ball discharging unit 43 (S6 to S8), the ball 11 received in the ball reception portion 23 is rolled toward the direction of the banked passage 29 by supplying power to the solenoid 102 (S10), and the rotation ejection nozzles 36 for ejecting air compressed by the compressor 14 are provided in the circumferential direction of the banked passage 29 for rolling the ball 11 rolled to the banked passage 29 in the circumferential direction along the banked passage 29 in accordance with the air pressure of air ejected from the rotation ejection nozzles 36 (S11). Thus, it is made possible to repeat rolling the ball 11 on the roulette wheel 12 and storing the ball 11 in any ball reception portion 23 without collecting the ball 11 from the roulette wheel 12, and the complicated mechanism such as moving parts for collecting the ball 11 and a discharging unit is not required. Therefore, the maintenance work is facilitated and the apparatus cost can be reduced. Since the required depth of each ball reception portion 23 and the required height of the roulette wheel 12 can be lessened, the viewing angle β for enabling the player to recognize the position of the ball 11 regardless of which ball reception portion 23 the ball 11 is received in (see FIG. 4) can be widened and it becomes easy for the player to recognize the ball 11, thus leading to improvement of game play amusement. The rod 101 is brought into contact with the ball 11 for discharging the ball 11 toward the direction of the banked passage 29, so that the force from the ball discharging unit 43 can be reliably transferred to the ball 11 and it is made possible to prevent a mistake of ball discharging.

Further, the fixed center section 22 is fixed and only the rotating circumferential section 20 is rotated, whereby the number of the drive parts of the roulette wheel 12 can be decreased and the load on the drive motor 34 can be lightened. The number of the ball discharging units 43 can be the minimum number (in the embodiment, one) regardless of the number of the ball reception portions 23, so that it is made possible to more simplify the structure of the roulette board 2.

Since the solenoid 102 is used as the drive source of the ball discharging unit 43, it is made possible to miniaturize and simplify the ball discharging unit 43, the maintenance work is facilitated, and the apparatus cost can be reduced. Further, since the required depth of each ball reception portion 23 and the required height of the roulette wheel 12 can be lessened, it becomes easy for the player to recognize the ball 11, leading to improvement of game play amusement.

Each ball reception portion 23 and the banked passage 29 are formed continuously in the presence of the slope 28 rising at the predetermined inclination angle from the ball reception portion 23 to the banked passage 29, so that it becomes easy for the player to recognize the ball 11 received in the ball reception portion 23, leading to improvement of game play amusement.

Since the banked passage 29 has the wall part 31 formed continuous with the banked passage 29 in the outer peripheral portion, it is not feared that the ball 11 rolling on the banked passage 29 will rush out into the outside of the roulette wheel 12 by the centrifugal force, and it is made possible for the player to play a game with safety.

Further, when the ball 11 is received in the ball reception portion 23, it is not feared that the ball 11 will be buried in the ball reception portion 23 because the diameter D of the ball 11 is larger than the depth L2 of the ball reception portion 23, and the player can easily recognize the position of the ball 11 received in the ball reception portion 23 during the game.

It is to be understood that the present invention is not limited to the specific embodiment thereof and various improvements, modifications, and changes may be made without departing from the spirit and the scope of the invention, needless to say.

For example, in the embodiment, the ball 11 discharged by the ball discharging unit 43 and rolled toward the direction of the banked passage 29 is rolled so as to draw a circumferential orbit along the banked passage 29 in accordance with the air pressure of air from the rotation ejection nozzles 36, but the frame 21 may be rotated without providing the rotation ejection nozzles 36. If the frame 21 is rotated, the ball 11 on the frame starts to rotate in the circumferential direction accordingly and rolls along the banked passage 29 by the centrifugal force produced by the rotation.

In the embodiment, the solenoid 102 is used as the drive source of the rod 101 brought into contact with the ball 11 received in the ball reception portion 23 for discharging the ball 11, but the drive source for moving the rod 101 back and forth is not limited to the solenoid 102; for example, an electric motor may be used.

In the embodiment, the rod passage hole 35 for allowing the rod 101 of the ball discharging unit 43 to pass through is a circular hole, but the shape may be a structure for allowing the rod 101 to pass through; the rod passage hole may be shaped like a groove formed in a lateral or longitudinal direction or a notch.

In the roulette board 1 according to the embodiment, it is described that a controller (main control CPU 80) controls the drive unit (drive motor 34) to rotate the rotating circumferential section 20 so that a received ball reception portion, in which the ball 11 is received, locates at a position where the ball discharging member (rod 101) is contactable with the ball 11 received in the received ball reception portion.

Figure 25:
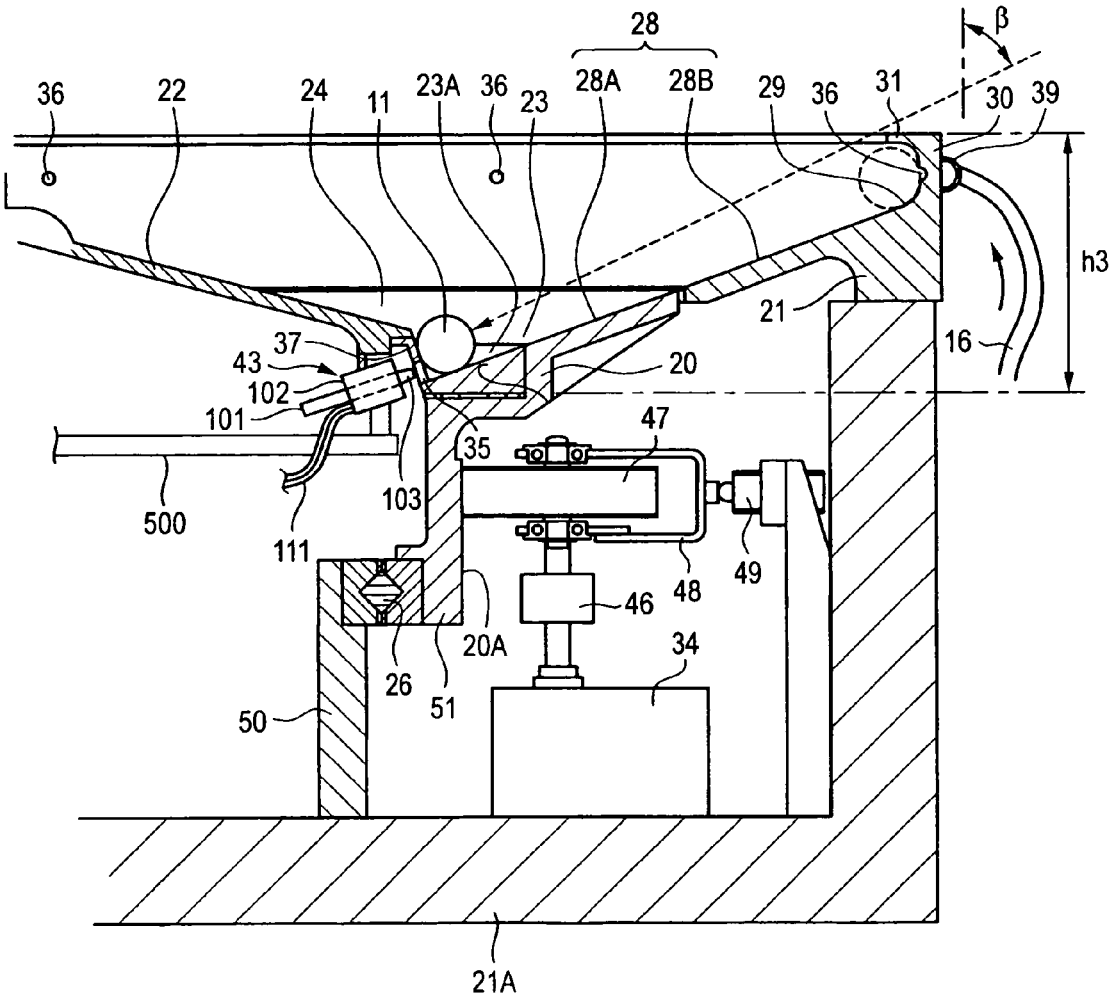
FIG. 25 is a schematic drawing to show a roulette gaming machine according to another embodiment.

However, the roulette board 1 may be configured to be provided with a movement mechanism 500 that moves a position of the ball discharging mechanism (ball discharging unit 43), as shown in FIG. 25, and that the controller (main control CPU 80) controls the movement mechanism 500 to move the position of the ball discharging mechanism so that the ball discharging mechanism locates at a position where the ball discharging member (rod 101) is contactable with the ball 11 received in the received ball reception portion.

The movement mechanism 500 may be configured by including: a rotating member provided underneath the fixed center section 22 and attached with the ball discharging unit 43 thereon; and a drive motor that rotates the rotating member. The rotating member may be formed in a disk shape in a rod shape.

Alternately, the movement mechanism 500 may be configured by including: an arm member having one or more joints; and one or more actuators that actuates the joints.

As described above in detail with reference to the embodiments, there is provided a roulette board (for example, roulette board 2) including a roulette wheel (for example, roulette wheel 12) on which a plurality of symbols (for example, number indication plates 24) are arranged in a circumferential direction of the roulette wheel; a plurality of ball reception portions (for example, ball reception portions 23) that are provided in a one-to-one correspondence with the symbols, the ball reception portions being configured to receive a ball (for example, ball 11) that rolls on the roulette wheel; a banked passage (for example, banked passage 29) that is endlessly provided along an outer circumference of the roulette wheel, and allows the ball to roll in a circumferential orbit; and a ball discharging mechanism (for example, ball discharging unit 43) that is provided with a ball discharging member and discharges the ball received in one of the ball reception portions toward the banked passage by bringing the ball discharging member into contact with the ball.

According to the roulette board configured as above, if the ball rolling on the roulette wheel with a plurality of symbols placed thereon is received in one of ball reception portions, the ball discharging mechanism can be brought into contact with the ball, thereby rolling the ball received in the ball reception portion toward the banked passage direction from the ejection nozzle. Therefore, it is made possible to repeat rolling the ball on the roulette wheel without collecting the ball from the roulette wheel, and the complicated mechanism of moving parts, etc., for collecting the ball and a discharging unit, etc., is not required, the maintenance work is facilitated, and the apparatus cost can be reduced. Since the required depth of each ball reception portion and the required height of the roulette wheel can be lessened, it becomes easy for the player to recognize the ball, leading to improvement of game play amusement. The ball discharging mechanism is brought into contact with the ball for discharging the ball toward the banked passage direction, so that the force from the ball discharging mechanism can be reliably transferred to the ball and it is made possible to prevent a mistake of ball discharging.

The roulette board may be configured that the roulette wheel includes: a fixed center section (for example, fixed center section 22) that is provided with the ball discharging mechanism; a rotating circumferential section (for example, rotating circumferential section 20) that surrounds the fixed center section, the rotating circumferential section being provided with the symbols and the ball reception portions; and a support member (for example, cross ball bearing 26) that supports the rotating circumferential section to be rotatable with respect to the fixed center section. The roulette board may further include a drive unit (for example, drive motor 34) that rotates the rotating circumferential section with respect to the fixed center section. The roulette board may further include a ball detection unit (for example, ball detection sensors 44, origin sensor 57, and rotation sensor 58) that detects a received ball reception portion from among the ball reception portions, the received ball reception portion receiving the ball therein; and a controller (for example, main control CPU 80, motor drive circuit 55) that controls the drive unit to rotate the rotating circumferential section so that the received ball reception portion locates at a position (for example, front position of the ball discharging unit 43) where the ball discharging member is contactable with the ball received in the received ball reception portion. The roulette board may further include: a ball detection unit (for example, ball detection sensors 44, origin sensor 57, and rotation sensor 58) that detects a received ball reception portion from among the ball reception portions, the received ball reception portion receiving the ball therein; a movement mechanism (for example, movement mechanism 500) that moves a position of the ball discharging mechanism; and a controller (for example, main control CPU 80, motor drive circuit 55) that controls the movement mechanism to move the position of the ball discharging mechanism so that the ball discharging mechanism locates at a position where the ball discharging member is contactable with the ball received in the received ball reception portion.

In the roulette board as configured as above, the rotating circumferential section is rotated with the ball reception portion matched with the position of the ball discharging mechanism, so that the ball received in the ball reception portion can be rolled by the ball discharging mechanism toward the banked passage direction. Therefore, it is made possible to repeat rolling the ball on the roulette wheel without collecting the ball from the roulette wheel, and the complicated mechanism of moving parts, etc., for collecting the ball and a discharging unit, etc., is not required, the maintenance work is facilitated, and the apparatus cost can be reduced. Since the required depth of each ball reception portion and the required height of the roulette wheel can be lessened, it becomes easy for the player to recognize the ball, leading to improvement of game play amusement.

Further, only the rotating circumferential section is rotated, whereby the number of the drive parts of the roulette wheel can be decreased and the load on the drive unit can be lightened. The number of the ball discharging mechanisms can be the minimum number (for example, one) regardless of the number of the ball reception portions, so that it is made possible to more simplify the structure of the roulette board.

The roulette board may be configured that the ball discharging mechanism include: a discharging rod (for example, rod 101) that is supported to be projectable into the ball reception portions at one end (for example, distal portion 103) thereof serving as the ball discharging member; a solenoid (for example, solenoid 102) that drives the discharging rod; and a power supply unit (for example, solenoid drive circuit 85) that supplies power to the solenoid.

In the roulette board configured as above, the solenoid is used as the drive source of the ball discharging mechanism, so that it is made possible to miniaturize and simplify the ball discharging mechanism, the maintenance work is facilitated, and the apparatus cost can be reduced. Since the required depth of each ball reception portion and the required height of the roulette wheel can be lessened, it becomes easy for the player to recognize the ball, leading to improvement of game play amusement.

The roulette board may be controlled by a method including: receiving the ball in one of the ball reception portions after rolling the ball on the roulette wheel for a predetermined time period; detecting a received ball reception portion from among the ball reception portions, the received ball reception portion receiving the ball therein (for example, S16); controlling the drive unit to rotate the rotating circumferential section so that the received ball reception portion locates at a position where the ball discharging member is contactable with the ball received in the received ball reception portion (for example, S6 to S8); and discharging the ball received in the received ball reception portion toward the banked passage with the ball discharging mechanism (for example, S10).

According to the method as described above, it is made possible to repeat rolling the ball on the roulette wheel without collecting the ball from the roulette wheel. Therefore, the complicated mechanism of moving parts, etc., for collecting the ball and a discharging unit, etc., is not required, the maintenance work is facilitated, and the apparatus cost can be reduced. Since the required depth of each ball reception portion and the required height of the roulette wheel can be lessened, it becomes easy for the player to recognize the ball, leading to improvement of game play amusement.

Further, only the rotating circumferential section is rotated, whereby the number of the drive parts of the roulette wheel can be decreased and the load on the drive unit can be lightened. The number of the ball discharging mechanisms can be the minimum number (for example, one) regardless of the number of the ball reception portions, so that it is made possible to more simplify the structure of the roulette board.

The foregoing description of the embodiments has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable those skilled in the art to utilize the invention in various embodiments and with various modifications as are suited to the particular use contemplated. It is intended that the scope of the invention be defined by the claims appended hereto, and their equivalents.

What is claimed is:

1. A roulette board comprising:

a roulette wheel on which a plurality of symbols are arranged in a circumferential direction of the roulette wheel;

a plurality of ball reception portions that are provided in a one-to-one correspondence with the symbols, the ball reception portions being configured to receive a ball that rolls on the roulette wheel;

a banked passage that is endlessly provided along an outer circumference of the roulette wheel, and allows the ball to roll in a circumferential orbit; and a ball discharging mechanism that is provided with a ball discharging member and discharges the ball received in one of the ball reception portions toward the banked passage by bringing the ball discharging member into contact with the ball, wherein the ball discharging member comprises a discharging rod, wherein the roulette wheel comprises a fixed center section that includes the ball discharging mechanism, wherein each of the ball reception portions is provided with a through hole that allows the ball discharging member to project therethrough for contacting with the ball, wherein the through hole in each of the ball reception portions is made in an inner wall, and wherein the inner wall forms each of the ball reception portions.

2. The roulette board according to claim 1, wherein the roulette wheel further comprises:

a rotating circumferential section that surrounds the fixed center section, the rotating circumferential section being provided with the symbols and the ball reception portions; and a support member that supports the rotating circumferential section to be rotatable with respect to the fixed center section, wherein the roulette wheel houses the ball discharging mechanism.

3. The roulette board according to claim 2, further comprising a drive unit that rotates the rotating circumferential section with respect to the fixed center section.

4. The roulette board according to claim 3, further comprising:

a ball detection unit that detects a received ball reception portion from among the ball reception portions, the received ball reception portion receiving the ball therein; and a controller that controls the drive unit to rotate the rotating circumferential section so that the received ball reception portion locates at a position where the ball discharging member is contactable with the ball received in the received ball reception portion.

5. The roulette board according to claim 3, further comprising:

a ball detection unit that detects a received ball reception portion from among the ball reception portions, the received ball reception portion receiving the ball therein;

a movement mechanism that moves a position of the ball discharging mechanism; and a controller that controls the movement mechanism to move the position of the ball discharging mechanism so that the ball discharging mechanism locates at a position where the ball discharging member is contactable with the ball received in the received ball reception portion.

6. The roulette board according to claim 1, wherein the ball discharging mechanism further comprises:

a solenoid that drives the discharging rod; and a power supply unit that supplies power to the solenoid, and wherein the discharging rod is adapted to be projectable into the ball reception portions at one end thereof.

7. The roulette board according to claim 1, wherein the ball discharging mechanism is disposed underneath the roulette wheel.

8. The roulette board according to claim 7, further comprising a ball detection unit that detects a received ball reception portion from among the ball reception portions, the received ball reception portion receiving the ball therein, wherein the ball detection unit includes at least one optical sensor that detects the ball based on a light received through the through hole.

9. The roulette board according to claim 8, wherein the ball detection unit includes a plurality of the optical sensors.

10. The roulette board according to claim 8, wherein the optical sensor emits an infrared light through the through hole, and detects the ball when an infrared light reflected by the ball is received through the through hole.

11. The roulette board according to claim 1, further comprising a nozzle that ejects air into the banked passage to roll the ball.

12. The roulette board according to claim 1, wherein the ball discharging mechanism further comprises a spring that is adapted to push the discharging rod in a direction away from contacting with the ball.

13. The roulette board according to claim 1, wherein if a power is supplied to the ball discharging mechanism, the discharging rod is adapted to pass through the through hole to collide with the ball.

14. The roulette board according to claim 1, wherein the ball discharging mechanism further comprises a plunger and a coil, wherein if a power is supplied to the ball discharging mechanism, the plunger is attracted to the coil so that the plunger moves the discharging rod to collide with the ball.

15. The roulette board according to claim 11, wherein the nozzle is located at a peripheral portion of the rotating circumferential section.

16. A method for controlling a roulette board, wherein the roulette board comprises:

a roulette wheel on which a plurality of symbols are arranged in a circumferential direction of the roulette wheel;

a plurality of ball reception portions that are provided in a one-to-one correspondence with the symbols, the ball reception portions being configured to receive a ball that rolls on the roulette wheel;

a banked passage that is endlessly provided along an outer circumference of the roulette wheel, and allows the ball to roll in a circumferential orbit; and a ball discharging mechanism that is provided with a ball discharging member and discharges the ball received in one of the ball reception portions toward the banked passage by bringing the ball discharging member into contact with the ball, wherein the roulette wheel comprises:

a fixed center section that is provided with the ball discharging mechanism;

a rotating circumferential section that surrounds the fixed center section, the rotating circumferential section being provided with the symbols and the ball reception portions; and a support member that supports the rotating circumferential section to be rotatable with respect to the fixed center section, and wherein the roulette board further comprising a drive unit that rotates the rotating circumferential section with respect to the fixed center section, the method comprising:

receiving the ball in one of the ball reception portions after rolling the ball on the roulette wheel for a predetermined time period;

detecting a received ball reception portion from among the ball reception portions, the received ball reception portion receiving the ball therein;

controlling the drive unit to rotate the rotating circumferential section so that the received ball reception portion locates at a position where the ball discharging member is contactable with the ball received in the received ball reception portion; and discharging the ball received in the received ball reception portion toward the banked passage with the ball discharging mechanism, wherein the ball discharging member comprises a discharging rod, wherein each of the ball reception portions is provided with a through hole that allows the ball discharging member to project therethrough for contacting with the ball, wherein the through hole in each of the ball reception portions is made in an inner wall, and wherein the inner wall forms each of the ball reception portions.

17. A roulette board controlling method, comprising:

rotating a rotating circumferential section of a roulette wheel with respect to a fixed center section of the roulette wheel;

rolling a ball on the roulette wheel for a predetermined time period;

receiving a ball in one of a plurality of ball reception sections;

detecting the received ball in said one of the plurality of ball reception sections, wherein the received ball is in contact with a ball discharging member; and discharging the received ball toward a banked passage of the roulette wheel, wherein the ball discharging member comprises a discharging rod, wherein the roulette wheel comprises a fixed center section that includes the ball discharging mechanism, wherein each of the ball reception sections is provided with a through hole that allows the ball discharging member to project therethrough for contacting with the ball, wherein the through hole in each of the ball reception sections is made in an inner wall, and wherein the inner wall forms each of the ball reception sections.

18. The roulette board controlling method according to claim 17, further comprising pushing the discharging rod in a direction away from contacting with the received ball before discharging the received ball toward the ball discharging member.

19. The roulette board controlling method according to claim 17, further comprising supplying a power to a ball discharging mechanism, wherein if the power is supplied to the ball discharging mechanism, the discharging rod is adapted to pass through the through hole to collide with the received ball.

20. The roulette board controlling method according to claim 17, further comprising supplying a power to a ball discharging mechanism, wherein if the power is supplied to the ball discharging mechanism, a plunger is attracted to the coil so that the plunger moves the discharging rod to collide with the ball.

* * * * *